US011553268B2

(12) United States Patent
Xu et al.

(10) Patent No.: US 11,553,268 B2
(45) Date of Patent: Jan. 10, 2023

(54) WIRELESS HEADSET

(71) Applicant: HUAWEI TECHNOLOGIES CO., LTD., Guangdong (CN)

(72) Inventors: Haowen Xu, Shanghai (CN); Bertrand Clerc, London (GB); Ying Zhao, Shanghai (CN); Xin Zhu, Shanghai (CN); Ning Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 111 days.

(21) Appl. No.: 17/280,224

(22) PCT Filed: Sep. 22, 2019

(86) PCT No.: PCT/CN2019/107158
§ 371 (c)(1),
(2) Date: Mar. 26, 2021

(87) PCT Pub. No.: WO2020/063499
PCT Pub. Date: Apr. 2, 2020

(65) Prior Publication Data

US 2022/0053255 A1 Feb. 17, 2022

(30) Foreign Application Priority Data

Sep. 27, 2018 (CN) ..... 201811133440.9
Dec. 12, 2018 (CN) ..... 201811523872.0
Jan. 31, 2019 (CN) ..... 201910099004.2

(51) Int. Cl.
*H04R 1/10* (2006.01)
*H04R 1/04* (2006.01)
*H04R 5/033* (2006.01)

(52) U.S. Cl.
CPC ..... *H04R 1/1025* (2013.01); *H04R 1/04* (2013.01); *H04R 1/1016* (2013.01);
(Continued)

(58) Field of Classification Search
CPC ..... H04R 1/10; H04R 1/105; H04R 1/1041; H04R 1/1025; H04R 2201/10; H04R 1/1033; H04R 5/0335; H04R 1/1091
See application file for complete search history.

(56) References Cited

U.S. PATENT DOCUMENTS 7,187,948 B2 * 3/2007 Alden ..... H04M 1/6066
2018/0109864 A1 4/2018 Yamamoto
2018/0199128 A1 7/2018 Chiu et al.

FOREIGN PATENT DOCUMENTS

CN 204518016 U 7/2015
CN 204836485 U 12/2015
(Continued)

OTHER PUBLICATIONS

International Search Report and Written Opinion issued in PCT/CN2019/107158, dated Dec. 19, 2019, 8 pages.
(Continued)

*Primary Examiner* — Kile O Blair

(57) ABSTRACT

A wireless headset includes a first headset part and a second headset part. The first headset part includes a first earplug, a battery box, and a first part of a cable control box. The first part of the cable control box includes a first interface, a first wireless chip configured to receive and send a wireless signal, and a processor configured to process the wireless signal. The battery box includes a first battery. The second headset part includes a second earplug and a second part of the cable control box, and the second part of the cable control box includes a second interface. The first interface is detachably connected to the second interface. When the first interface is electrically connected to the second interface, a data path is formed between the second earplug and the processor, and the first battery supplies power to the second earplug.

20 Claims, 16 Drawing Sheets

(52) U.S. Cl.
CPC ..... *H04R 1/1033* (2013.01); *H04R 1/1041* (2013.01); *H04R 5/0335* (2013.01); *H04R 2420/07* (2013.01); *H04R 2420/09* (2013.01)

(56) References Cited

FOREIGN PATENT DOCUMENTS

| | | | |
|---|---|---|---|
| CN | 204836508 | U | 12/2015 |
| CN | 204859502 | U | 12/2015 |
| CN | 205408115 | U | 7/2016 |
| CN | 106231474 | A | 12/2016 |
| CN | 205864688 | U | 1/2017 |
| CN | 206226668 | U | 6/2017 |
| CN | 206506677 | U | 9/2017 |
| CN | 206686338 | U | 11/2017 |
| CN | 107889012 | A | 4/2018 |
| CN | 207460443 | U | 6/2018 |
| CN | 108322839 | A | 7/2018 |
| CN | 207677947 | U | 7/2018 |
| CN | 108366310 | A | 8/2018 |

OTHER PUBLICATIONS

Notice of Allowance issued in CN201910099004.2, dated Jan. 8, 2021, 4 pages.
Office Action issued in CN201910099004.2, dated Aug. 3, 2020, 9 pages.

* cited by examiner

WIRELESS HEADSET

CROSS-REFERENCE TO RELATED APPLICATIONS

This application is a national stage of International Application No. PCT/CN2019/107158, filed on Sep. 22, 2019, which claims priority to Chinese Patent Application No. 201910099004.2, filed on Jan. 31, 2019 and Chinese Patent Application No. 201811523872.0, filed on Dec. 12, 2018 and Chinese Patent Application No. 201811133440.9, filed on Sep. 27, 2018. The disclosures of all of the aforementioned patent applications are hereby incorporated by reference in their entireties.

TECHNICAL FIELD

Embodiments of this application relate to the field of electronic technologies, and in particular, to a wireless headset.

BACKGROUND

As users demand more on convenience of a headset and some manufacturers cancelled headset jacks for electronic devices such as mobile phones, wireless headsets are favored by more and more users.

The wireless headset is powered by a battery of the wireless headset. Referring to FIG. 1, when a battery level is low, the wireless headset may be connected to a male connector 03 of a charging cable 02 through a disposed USB female connector 01, to be connected to a power supply through the charging cable 02. In this way, the battery of the wireless headset is charged.

In a case in which it is difficult to connect the wireless headset to a power supply on a trip such as on a train, on an airplane, in a car, or outdoors, the wireless headset cannot be charged, and the wireless headset cannot continue to be used.

SUMMARY

Embodiments of this application provide a wireless headset, and the wireless headset can be conveniently charged.

To achieve the foregoing objective, the following technical solutions are used in the embodiments of this application.

Embodiments of this application provides a wireless headset, including a first headset part and a second headset part. The first headset part includes a first earplug, a battery box, and a first part of a cable control box. The first earplug is wiredly connected to the battery box, and the battery box is wiredly connected to the first part of the cable control box. The first part of the cable control box includes a first interface, a first wireless chip configured to receive and send a wireless signal, and a processor configured to process the wireless signal. The battery box includes a first battery. The second headset part includes a wiredly connected second earplug and a second part of the cable control box, and the second part of the cable control box includes a second interface. The first interface is detachably connected to the second interface. When the first interface is electrically connected to the second interface, a data path is formed between the second earplug and the processor, and the first battery supplies power to the second earplug. The first interface is further configured to: when being detached from the second interface and being electrically connected to a first external power supply, charge the first battery.

In this way, the wireless headset may be conveniently charged through the first interface disposed on the wireless headset. Therefore, there is no need to carry an additional charging cable.

In an example embodiment, the first external power supply is a first electronic device, and the first interface is further configured to: when being detached from the second interface and being electrically connected to the first electronic device, receive first audio data sent by the first electronic device. The first earplug is configured to play the first audio data.

In other words, when charging the wireless headset, the first interface may further receive the audio data through a wired connection to the first electronic device, and the first earplug may play the audio data as normal when the wireless headset is charged.

In another example embodiment, the first external power supply is a first electronic device, and the first wireless chip is further configured to: when the first interface is detached from the second interface, and the first interface is electrically connected to the first electronic device, receive first audio data sent by the first electronic device. The first earplug is configured to play the first audio data.

In other words, when the first interface charges the wireless headset, the first wireless chip in the wireless headset may receive the audio data through a wireless connection, and the first earplug may play the audio data as normal when the wireless headset is charged.

In another example embodiment, the first external power supply is a first electronic device, and the first wireless chip is specifically configured to: when the first interface is detached from the second interface, and the first interface is electrically connected to the first electronic device, establish a wireless connection to the first electronic device. The processor is further configured to determine whether quality of the wireless connection established between the first wireless chip and the first electronic device is higher than a preset value. The first interface is further configured to: when the first interface is detached from the second interface and is electrically connected to the first electronic device, if the quality of the wireless connection is lower than the preset value, receive first audio data sent by the first electronic device. The first wireless chip is further configured to: when the first interface is detached from the second interface, and the first interface is electrically connected to the first electronic device, if the quality of the wireless connection is higher than the preset value, receive the first audio data that is sent by the first electronic device through the wireless connection. The first earplug is configured to play the first audio data.

In other words, the wireless headset may determine, based on the quality of the wireless connection established between the first wireless chip and the another electronic device, whether to wiredly or wirelessly receive the audio data.

In another example embodiment, after the first interface is detached from the second interface, and the first interface is inserted into the first electronic device, if the first wireless chip does not perform wireless pairing with the first electronic device, the first wireless chip performs the wireless pairing with the first external power supply. If the first electronic device has been paired with the first wireless chip, the first electronic device charges the first battery through the first interface. For example, when the first wireless chip is a first Bluetooth chip, that the first interface is inserted into the first external power supply may trigger the first Bluetooth chip to perform Bluetooth pairing with the first external power supply.

In this way, when communication subsequently needs to be performed through the wireless connection between the first wireless chip and the first external power supply, the wireless pairing does not need to be performed again, and the wireless connection may be directly established based on the wireless pairing.

In another example embodiment, the second earplug includes a second wireless chip and a second battery. The second wireless chip is configured to: when the first interface is detached from the second interface, establish a wireless connection to a second electronic device, and receive second audio data sent by the second electronic device. The second battery is configured to supply power to the second earplug. The second earplug is configured to play the second audio data.

In this way, the second interface may charge the second battery in the second earplug, and the second earplug may play the audio data as normal when the second battery is charged.

In another example embodiment, a back surface of the first earplug further includes a first magnetic attachment component, and a back surface of the second earplug further includes a second magnetic attachment component. The second interface is configured to: when the second interface is detached from the first interface, the second interface is electrically connected to a second external power supply, and the first magnetic attachment component is electrically connected to the second magnetic attachment component, charge the first battery.

In this way, when the first interface is detached from the second interface, and the first headset part is electrically connected to the second headset part through the magnetic attachment component, the second interface in the second headset part may be configured to charge the first battery in the first headset part.

In another example embodiment, the wireless headset further includes a first connection plug and a second connection plug, the first interface is electrically connected to the first connection plug, and the second interface is electrically connected to the second connection plug. The second interface is configured to: when the second interface is detached from the first interface, the second interface is electrically connected to a second external power supply, and the first connection plug is electrically connected to the second connection plug, charge the first battery.

In this way, when the first interface is detached from the second interface, and the first headset part is electrically connected to the second headset part through the connection plug, the second interface in the second headset part may be configured to charge the first battery in the first headset part.

In another example embodiment, the wireless headset further includes a jumper, and the first interface is electrically connected to the second interface through the jumper. The second interface is configured to: when being detached from the first interface and being electrically connected to a second external power supply, charge the first battery.

In this way, when the first interface is detached from the second interface, and the first headset part is electrically connected to the second headset part through the jumper, the second interface in the second headset part may be configured to charge the first battery in the first headset part.

In another example embodiment, the battery box further includes a wireless charging coil. The wireless charging coil is configured to: when generating an alternating magnetic field with another coil, charge the first battery.

The wireless charging coil may be independently used to charge the first battery. Alternatively, the wireless charging coil may be used with at least one of the first interface or the second interface to charge the first battery.

In another example embodiment, the second earplug includes a second battery. The second interface is configured to: when being detached from the first interface and being electrically connected to a second external power supply, charge the second battery.

In other words, the second interface in the second headset part may charge the second battery in the second headset part.

In another example embodiment, the second external power supply is a third electronic device. The second interface is further configured to: when being detached from the first interface and being electrically connected to the third electronic device, receive third audio data sent by the third electronic device. The second earplug is configured to play the third audio data.

In other words, when charging the second battery, the second interface may further receive the audio data through a wired connection to the another electronic device, and the second earplug may play the audio data as normal.

In another example embodiment, after the first interface is detached from the second interface, and the second interface is inserted into the second external power supply, if the second wireless chip does not perform wireless pairing with the second external power supply, the second wireless chip may be triggered to perform wireless pairing with the second external power supply.

In this way, when communication subsequently needs to be performed through the wireless connection between the second wireless chip and the second external power supply, the wireless pairing does not need to be performed again, and the wireless connection may be directly established based on the wireless pairing.

In another example embodiment, the second earplug includes a second battery, and when the first interface is detached from the second interface, the first headset part is electrically connected to the second headset part through a connection component.

In this way, current and audio data may be interacted between the first headset part and the second headset part that are electrically connected.

In another example embodiment, the connection component includes a first magnetic attachment component on a back surface of the first earplug and a second magnetic attachment component on a back surface of the second earplug. The first interface is configured to: when the first interface is detached from the second interface, the first interface is electrically connected to the first external power supply, and the first magnetic attachment component is electrically connected to the second magnetic attachment component, charge the first battery and the second battery. The second interface is configured to: when the second interface is detached from the first interface, the second interface is electrically connected to a second external power supply, and the first magnetic attachment component is electrically connected to the second magnetic attachment component, charge the first battery and the second battery.

In this way, when the first interface is detached from the second interface, and the first headset part is electrically connected to the second headset part through the magnetic attachment component, the first interface in the first headset part may charge the first battery in the first headset part and the second battery in the second headset part. The second interface in the second headset part may also charge the first battery in the first headset part and the second battery in the second headset part.

In another example embodiment, the connection component includes a first connection plug electrically connected to the first interface and a second connection plug electrically connected to the second interface. The first interface is configured to: when the first interface is detached from the second interface, the first interface is electrically connected to the first external power supply, and the first connection plug is electrically connected to the second connection plug, charge the first battery and the second battery. The second interface is configured to: when the second interface is detached from the first interface, the second interface is electrically connected to a second external power supply, and the first connection plug is electrically connected to the second connection plug, charge the first battery and the second battery.

In this way, when the first interface is detached from the second interface, and the first headset part is electrically connected to the second headset part through the connection plug, the first interface in the first headset part may charge the first battery in the first headset part and the second battery in the second headset part. The second interface in the second headset part may also charge the first battery in the first headset part and the second battery in the second headset part.

In another example embodiment, the connection component includes a jumper configured to electrically connect the first interface and the second interface. The first interface is configured to: when being detached from the second interface and being electrically connected to the first external power supply, charge the first battery and the second battery. The second interface is configured to: when being detached from the first interface and being electrically connected to a second external power supply, charge the first battery and the second battery.

In this way, when the first interface is detached from the second interface, and the first headset part is electrically connected to the second headset part through the jumper, the first interface in the first headset part may charge the first battery in the first headset part and the second battery in the second headset part. The second interface in the second headset part may also charge the first battery in the first headset part and the second battery in the second headset part.

In another example embodiment, the cable control box further includes a wireless charging coil. The wireless charging coil is configured to: when the wireless charging coil generates an alternating magnetic field with another coil, and the first headset part is electrically connected to the second headset part through the connection component, charge the first battery and the second battery.

The wireless charging coil may be independently used to charge the first battery and the second battery. Alternatively, the wireless charging coil may be used with at least one of the first interface or the second interface to charge the first battery and the second battery.

In another example embodiment, the first external power supply or the second external power supply is a fourth electronic device, and the second earplug further includes a second wireless chip. The first wireless chip, the second wireless chip, and the first interface or the second interface is configured to: when the first interface is detached from the second interface, the first interface or the second interface is electrically connected to the fourth electronic device, and the first headset part is electrically connected to the second headset part through the connection component, receive fourth audio data sent by the fourth electronic device. The first earplug or the second earplug is configured to play the fourth audio data.

In other words, when the first interface is detached from the second interface, and the first headset part is electrically connected to the second headset part through the connection component, the wireless headset may receive the audio data in a wired connection manner between the first interface or the second interface and the another electronic device. Alternatively, the wireless headset may receive the audio data in a wireless connection manner through the first wireless chip or the second wireless chip.

In another example embodiment, the wireless headset further includes an input detection module. The first interface is further configured to: when the first interface is detached from the second interface, and the input detection module detects an indication that a user indicates to charge the another electronic device, output a current to the another electronic device. The second interface is further configured to: when the second interface is detached from the first interface, and the input detection module detects the indication that the user indicates to charge the another electronic device, output a current to the another electronic device.

In this way, the wireless headset may charge another electronic device in response to the indication information that is of the user and that is detected by the input detection module.

For example, the input detection module may include a microphone, a touch sensor, or the like.

In another example embodiment, when the first interface and the second interface are plugged together, the battery box and the cable control box are symmetrically distributed on two sides of a second connection cable.

The symmetrical distribution of the battery box and the cable control box may make the wireless headset more aesthetic.

In another example embodiment, the first wireless chip and the second wireless chip are Bluetooth chips.

In this way, the wireless headset may establish a Bluetooth connection through the Bluetooth chip, and receive audio data through the Bluetooth connection.

In another example embodiment, the first interface is a male connector, and the second interface is a female connector.

For example, the first interface is a male connector of a USB Type-C connector, and the second interface is a female connector of the USB Type-C connector.

In another example embodiment, the first external power supply is the another electronic device, and the first interface is directly inserted into the another electronic device, to be electrically connected to the another electronic device.

In this way, the first interface is directly inserted into the another electronic device carried by the user to charge the battery of the wireless headset. Therefore, charging can be more convenient.

In another example embodiment, the first interface is a female connector, and the second interface is a male connector.

For example, the first interface is a female connector of a USB Type-C connector, and the second interface is a male connector of the USB Type-C connector.

In another example embodiment, the first external power supply is a mobile power supply or a power plug, and the first interface is electrically connected to the first external power supply through a connection cable.

In another example embodiment, the first interface, the second interface, and the first battery are disposed in a cavity of the battery box, and the processor and the first wireless chip are disposed in a cavity of the cable control box.

In this way, a wireless headset with another structure can be provided.

In another example embodiment, the first interface, the second interface, the first battery, the processor, and the first wireless chip are disposed in a same cavity.

In this way, a wireless headset with another structure can be provided.

BRIEF DESCRIPTION OF DRAWINGS

FIG. 7A is a schematic diagram of a charging manner of a wireless headset according to an embodiment of this application;

DESCRIPTION OF EMBODIMENTS

The following describes technical solutions of embodiments in this application with reference to accompanying drawings. In description of the embodiments of this application, "I" means "or" unless otherwise specified. For example, A/B may represent A or B. In this specification, "and/or" describes only an association relationship for describing associated objects and represents that three relationships may exist. For example, A and/or B may represent the following three cases: Only A exists, both A and B exist, and only B exists. In addition, in the descriptions in the embodiments of this application, "a plurality of" means two or more than two.

Figure 1:
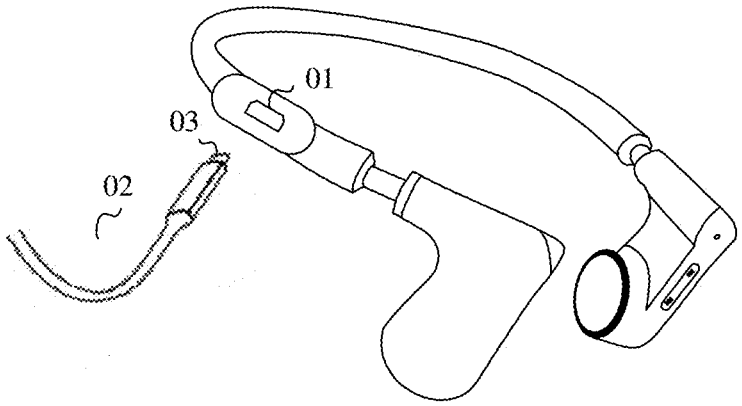
FIG. 1 is a schematic diagram of a charging manner of a wireless headset according to prior art.
Figure 2:
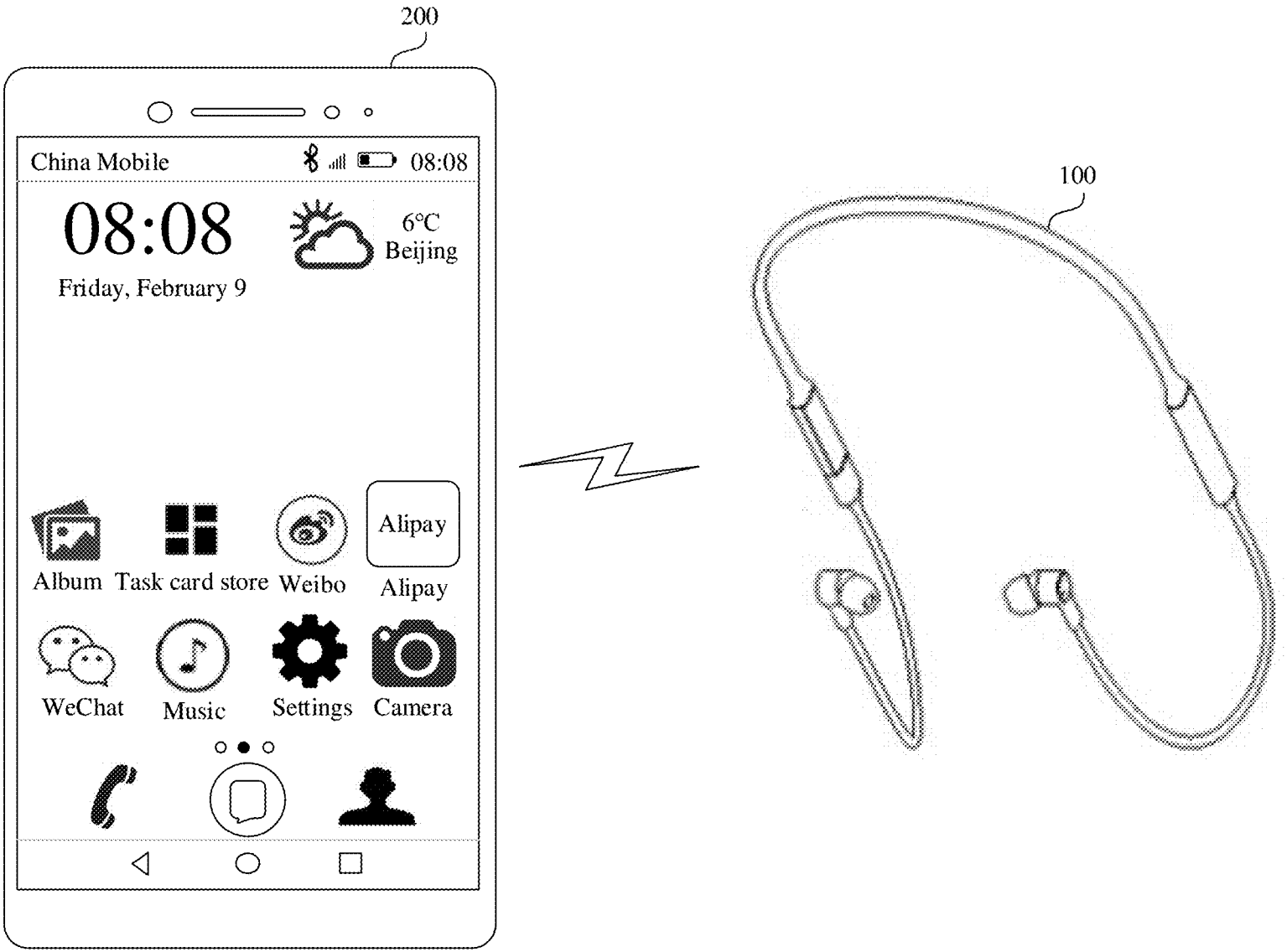
FIG. 2 is a schematic diagram of an application scenario of a wireless headset according to an embodiment of this application.

As shown in FIG. 2, an embodiment of this application provides a wireless headset 100. The wireless headset 100 includes two earplugs that are wiredly connected. The wireless headset 100 may communicate with another electronic device 200 in a wireless manner, to receive audio data from the another electronic device or send audio data to the another electronic device. After receiving the audio data from the another electronic device 200, the wireless headset 100 may perform synchronous playing (for example, stereo playing) on the audio data through the two earplugs. A left earplug is configured to synchronously play a left sound channel signal, and a right earplug is configured to synchronously play a right sound channel signal.

The wireless manner may be one or more of connections such as Bluetooth (BT), a wireless fidelity (Wi-Fi) network, a global navigation satellite system (GNSS), frequency modulation (FM), a near field communication (NFC) technology, or an infrared technology (infrared, IR). For example, the wireless headset 100 may be a neckband wireless headset, a head mounted wireless headset, or another portable wireless listening device. For example, the electronic device that wirelessly communicates with the wireless headset may be devices such as a mobile phone, a media player (for example, an MP3 or an MP4), a tablet computer, a notebook computer, an ultra-mobile personal computer (UMPC), a personal digital assistant (PDA), a television, or a smart watch.

In FIG. 2, an example in which the wireless headset 100 is the neckband wireless headset is used, and an example in which the electronic device 200 that wirelessly communicates with the wireless headset 100 is a mobile phone is used for description. The electronic device 200 may alternatively be any other kind of device. This is not limited in embodiments of this application.

Figure 3:
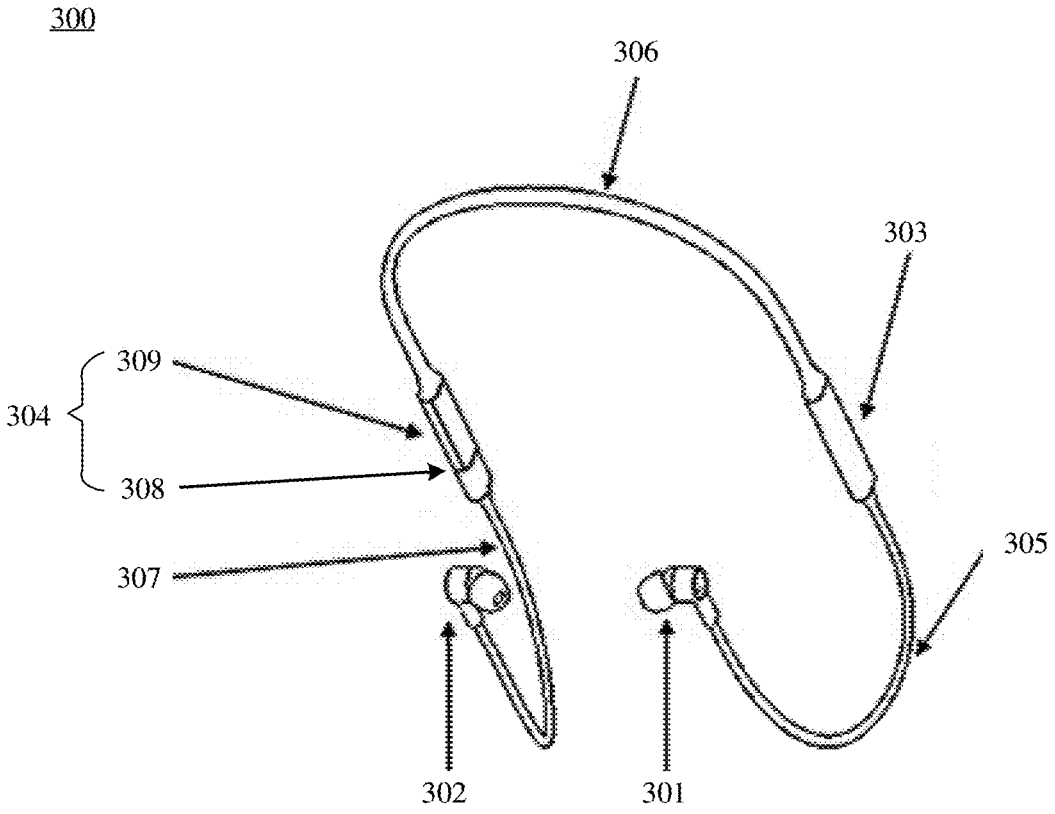
FIG. 3 is a schematic diagram of an appearance of a wireless headset according to an embodiment of this application.

For example, when the wireless headset 100 is the neckband wireless headset, FIG. 3 is a schematic structural diagram of a neckband wireless headset 300. As shown in FIG. 3, the neckband wireless headset 300 may include: a first earplug 301, a second earplug 302, a battery box 303, a cable control box 304, and the like. The first earplug 301 is wiredly connected to the battery box 303, the battery box 303 is wiredly connected to the cable control box 304, and the cable control box 304 is wiredly connected to the second earplug 302. For example, as shown in FIG. 3, the first earplug 301 is electrically connected to the battery box 303 through a first connection cable 305, the battery box 303 is electrically connected to the cable control box 304 through a second connection cable 306, and the cable control box 304 is electrically connected to the second earplug 302 through a third connection cable 307.

The first earplug may be a left earplug, and the second earplug may be a right earplug. Alternatively, the first earplug may be the right earplug, and the second earplug may be the left earplug. This is not limited in the embodiments of this application.

The battery box 303 includes an electrically connected first battery, a wiring terminal, a power sourcing control chip, a temperature detection circuit, and the like. The power sourcing control chip is configured to: transmit an externally input current to the first battery through the wiring terminal, and perform overvoltage detection, overcurrent detection, and the like. The temperature detection circuit can monitor temperature during charging. The first battery can supply power to components included in the neckband wireless headset. The first battery may be a rechargeable battery.

As shown in FIG. 3, the cable control box 304 includes a headset connection interface 308 and a control module 309 that are electrically connected. The headset connection interface 308 includes a first interface and a second interface that are pluggable. The first interface is electrically connected to the control module 309, the control module 309 is electrically connected to the second connection cable 306, and the second interface is electrically connected to the second earplug 302 through the third connection cable 307. For example, referring to FIG. 4, the first interface may be a male connector 401, and the second interface may be a female connector 402.

The first interface is detachably connected to the second interface. When the first interface is detached from the second interface, the first interface and the second interface that are pluggable are unplugged, and the first interface is fully exposed. When the first interface is not electrically connected to the second interface, the first interface and/or the second interface may be electrically connected to an external power supply to charge the first battery. The external power supply may be a charging device such as another electronic device, a mobile power supply, or a fixed power plug.

When the first interface and the second interface are not detached, in other words, referring to FIG. 3, the first interface and the second interface are plugged together, and the first interface and the second interface are electrically connected through direct contact, the first battery may supply power to the first earplug, and a wireless data signal received by the control module 309 from the another electronic device may be transmitted to the first earplug 301 through the second connection cable 306, the battery box 303, and the first connection cable 305. A data path and a power supply path are formed between the second earplug 302 and the control module 309. The wireless data signal may be further transmitted to the second earplug 302 through the first interface, the second interface, and the third connection cable 307, and the first battery may further supply power to the second earplug 302.

Figure 5:
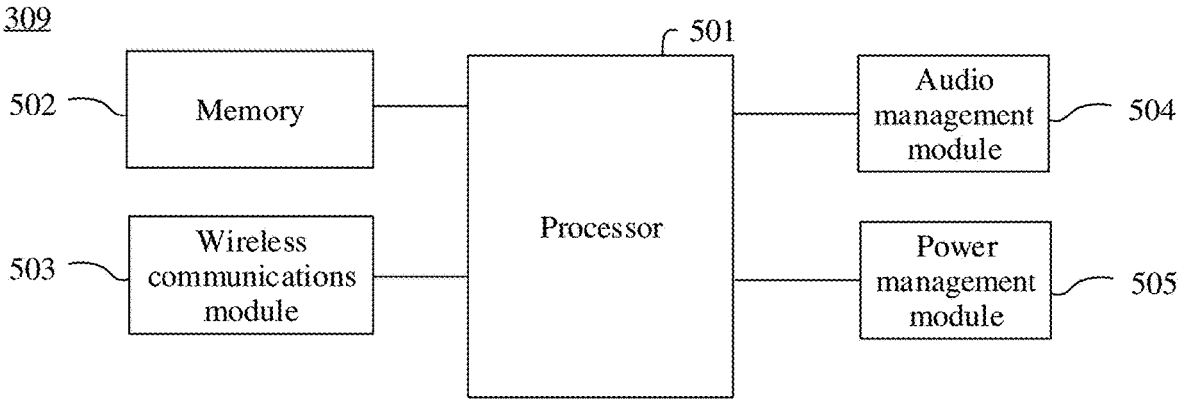
FIG. 5 is a schematic structural diagram of a control module according to an embodiment of this application.

Referring to FIG. 5, the control module 309 in the cable control box 304 may include at least one processor 501, at least one memory 502, a wireless communications module 503, an audio management module 504, a power management module 505, and the like. The processor may include one or more interfaces, configured to connect to another module in the control module 309.

The memory may be configured to store program code, for example, program code used for charging a neckband wireless headset, and application program code used for performing wireless pairing with and establishing a connection with an electronic device. The memory may further store a Bluetooth address used to uniquely identify the neckband wireless headset. In addition, the memory may further store a pairing history of an electronic device that is successfully paired with the neckband wireless headset before. Based on the pairing history, the neckband wireless headset can automatically establish a connection to the paired electronic device. The Bluetooth address may be a media access control (MAC) address.

The processor may be configured to execute the foregoing application program code, and invoke a related module such as the audio management module and the power management module, to implement a function of the neckband wireless headset in this embodiment of this application. For example, a charging function and an audio data playing function of the neckband wireless headset are implemented.

The wireless communications module may be configured to support data exchange of wireless communication between the neckband wireless headset and another electronic device. The wireless communication includes a wireless local area network (WLAN) (such as a wireless fidelity (Wi-Fi) network), Bluetooth (BT), a global navigation satellite system (GNSS), frequency modulation (FM), a near field communication (NFC) technology, and an infrared (IR) technology. In some embodiments, the wireless communications module may be a first wireless chip, for example, a first Bluetooth chip. The neckband wireless headset may perform pairing with and establishing a wireless connection with a Bluetooth chip of the electronic device through the first Bluetooth chip, to implement short-distance data exchange between the neckband wireless headset and the electronic device through the wireless connection.

The audio management module may be configured to manage audio data, and control an audio signal played (for example, a dual sound channel signal or a mono sound channel signal is played) by a first earplug and a second earplug. In some embodiments, the audio management module may obtain an audio signal from the wireless communications module or a headset connection interface, or transmit an audio signal to the wireless communications module or the headset connection interface, to implement, through a Bluetooth headset, functions such as making a call, playing music, enabling or disabling a voice assistant of the electronic device that is connected to the headset, receiving or sending voice data of a user, and the like.

The power management module may be configured to support the neckband wireless headset in receiving charging input, or charge the another electronic device. For example, when the first interface and/or the second interface are/is connected to or directly inserted into an adaptive power supply or the another electronic device, the power management module receives the charging input through the first interface and/or the second interface. In some wireless charging embodiments, the power management module may receive wireless charging input through a wireless charging coil in the cable control box or a battery box. When receiving the charging input to charge a battery of the neckband wireless headset, the power management module may further supply power to support normal functions of the neckband wireless headset.

The power management module may be further configured to supply power to modules such as the processor, the memory, and the wireless communications module. The power management module may be further configured to monitor parameters such as a battery capacity, a battery cycle count, and a battery health status (electric leakage or impedance). In some other embodiments, the power management module may alternatively be disposed in the processor.

A structure of the first earplug may be the same as or different from that of the second earplug. The earplugs (that is, the first earplug and the second earplug) herein may include at least one receiver, which may also be referred to as an "earpiece", and may be configured to: convert an audio electrical signal into a sound signal, and play the sound signal. For example, when the earplug of the neckband wireless headset is used as an audio output device of the electronic device, the receiver may convert the received audio electrical signal into the sound signal and play the sound signal.

In addition, the earplug may further include a sensor. For example, the sensor may be a distance sensor or an optical proximity sensor. The neckband wireless headset may determine, through the sensor, whether the neckband wireless headset is worn by the user. For example, the earplug may detect, through the optical proximity sensor, whether there is an object near the earplug, to determine whether the earplug is worn by the user. When it is determined that the earplug is worn, the earplug may open the receiver. In some embodiments, the earplug may further include a bone conduction sensor, to obtain a bone conduction headset. By using the bone conduction sensor, the earplug can obtain a vibration signal of a vibration bone of a vocal-cord part, and obtain a speech signal through parsing, to implement a speech function.

The foregoing second connection cable may be further used in combination with a memory metal. For example, the second connection cable and the memory metal may be disposed in parallel, and an insulation layer such as a rubber layer may be coated outside the second connection cable and the memory metal, to form a neckband cable. The neckband cable including the memory metal keeps a given radian and is more comfortable to use when hung on a neck. Usually, for aesthetics, the cable control box and the battery box may be symmetrically distributed on two sides of the neckband cable, and the cable control box and the battery box are basically of a same size. In comparison with a case in which the first battery and the headset connection interface 308 are combined in a box on one side, as shown in FIG. 3, when the first battery is independently placed in a box on one side, the neckband wireless headset may have a comparatively large battery volume and a comparatively large battery capacity. Therefore, the use duration of the neckband wireless headset can be increased.

In addition, the neckband wireless headset may further include at least one microphone, which may also be referred to as a "mike" or a "microphone", and is configured to convert a sound signal into an audio electrical signal. For example, when the neckband wireless headset is used as an audio input device of the electronic device, in a process in which the user talks (for example, makes a call or sends a voice message), the microphone may collect a sound signal of the user, to control the neckband wireless headset to perform a corresponding operation, or convert the sound signal into an audio signal, and send the audio signal to the electronic device. For example, the microphone may be disposed on the cable control box.

An outer surface of the cable control box of the neckband wireless headset, or an outer surface of the earplug, may further include a touch sensor, configured to detect a touch operation of the user; a fingerprint sensor, configured to: detect a fingerprint of the user, and identify an identity of the user, and the like; an ambient optical sensor, configured to adaptively adjust some parameters such as a volume based on luminance of sensed ambient light; and some other sensors.

The neckband wireless headset may further include an antenna. The wireless communications module receives an electromagnetic wave through the antenna, performs frequency modulation and filtering processing on the electromagnetic wave signal, and sends a processed signal to the processor. The wireless communications module may further receive a to-be-sent signal from the processor, perform frequency modulation and amplification on the signal, and convert the signal into an electromagnetic wave for radiation through the antenna.

It may be understood that the structure shown in the embodiments of this application does not constitute a specific limitation on the neckband wireless headset. The neckband wireless headset may have more or fewer components than those shown in FIG. 3 to FIG. 5, and may combine two or more components, or may have different component configurations. For example, the cable control box of the neckband wireless headset or a back surface of the earplug may further include components such as an indicator (which may indicate a status such as a battery level), a display screen (which may prompt related information to the user), a dust filter (which may be used with the receiver), and a control. The cable control box or the earplug may further include a component such as a motor. The control may include a physical button, a touch button (which is used in cooperation with the touch sensor), and the like, and is configured to trigger operations such as powering on, powering off, pausing, playing, recording, charging, and ending charging.

Figure 4:
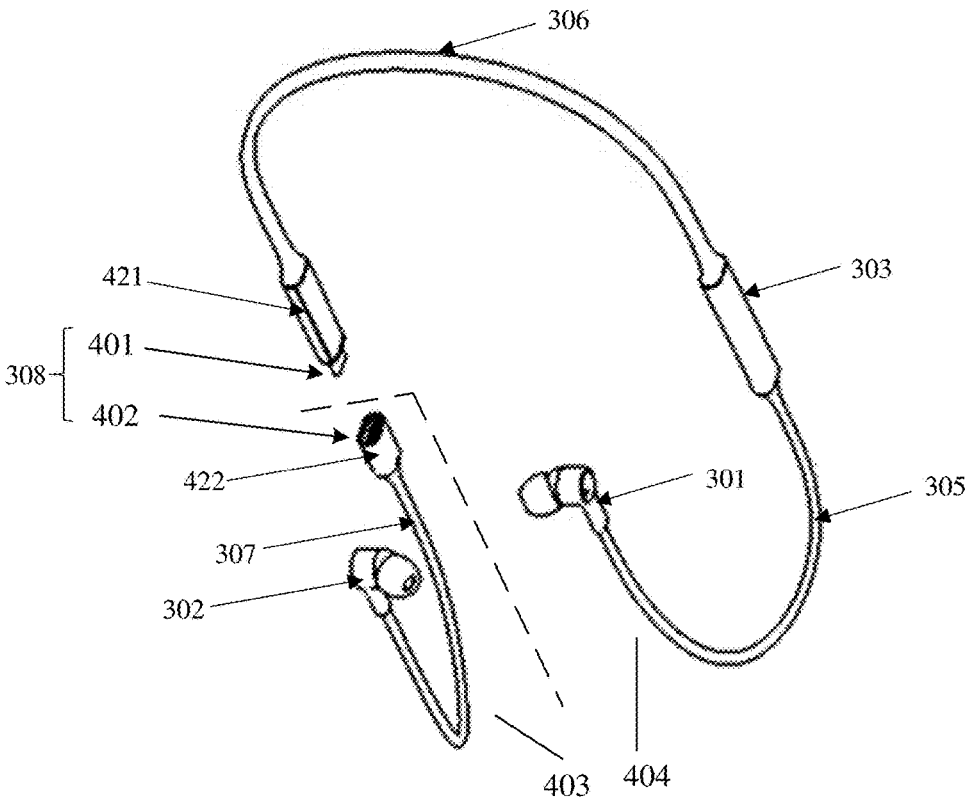
FIG. 4 is a schematic diagram of another appearance of a wireless headset according to an embodiment of this application.

Various components shown in FIG. 3 to FIG. 5 may be implemented in hardware, software, or a combination of hardware and software that includes one or more signal processing or application-specific integrated circuits.

The following embodiments of this application are described by using an example in which the wireless headset 100 is the neckband wireless headset, the electronic device is the mobile phone, and wireless communication is performed between the mobile phone and the neckband wireless headset in a Bluetooth manner.

The neckband wireless headset may exchange audio data through a Bluetooth connection to the mobile phone. The audio data may include media data, voice data, and the like. For example, the neckband wireless headset may play media data such as music, a recording, and a sound in a video file for the user. In scenarios of a phone call, an audio call, or a video call, the neckband wireless headset may play an incoming call prompt tone, play voice data of an opposite end of the call, collect voice data of the user, and send the voice data to the mobile phone. In a game scenario, the neckband wireless headset may play background music, a game prompt tone, voice data of a teammate, and the like, collect voice data of the user, and send the voice data to the mobile phone. In a WeChat voice message scenario, the neckband wireless headset may play a voice message, collect voice data recorded by the user, and send the voice data to the mobile phone. In a scenario such as a voice assistant, the neckband wireless headset may collect voice data of the user, and send the voice data to the mobile phone.

The following embodiment uses a scenario in which the user uses the mobile phone and the neckband wireless headset to play the music as an example for description.

Figure 6:
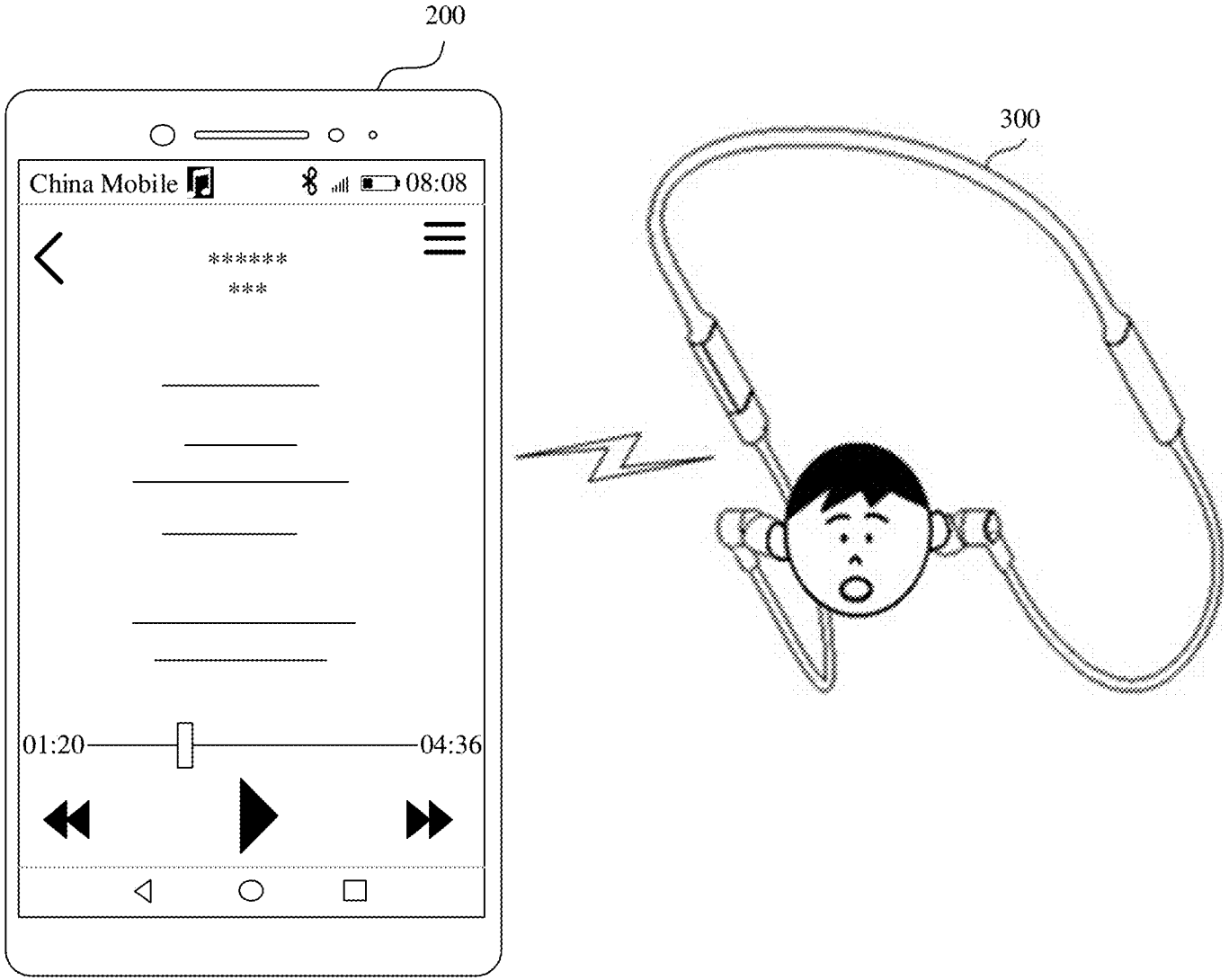
FIG. 6 is a schematic diagram of another scenario according to an embodiment of this application.

When the mobile phone and the neckband wireless headset are used to listen to the music, a Bluetooth pairing connection may be first established between the first Bluetooth chip in the neckband wireless headset and the mobile phone. After the user enables a music playing service by using the mobile phone, for example, referring to FIG. 6, the user may use the neckband wireless headset to enjoy the music through the Bluetooth connection.

When the neckband wireless headset is used to listen to the music as normal, the first interface and the second interface are plugged together, and the first Bluetooth chip in the neckband wireless headset may receive the audio data sent by the mobile phone through the Bluetooth. The processor may invoke the audio management module to transmit the audio data received from the mobile phone to the first earplug through the second connection cable, the battery box, and the first connection cable, and transmit the audio data to the second earplug through the first interface, the second interface, and the third connection cable. In an example solution, the processor may invoke the audio management module to send a left sound channel signal to a left earplug and send a right sound channel signal to a right earplug. In another example solution, the processor may invoke the audio management module to send same audio data to the left earplug and the right earplug. The left earplug plays the left sound channel signal, and the right earplug plays the right sound channel signal.

In a case in which the neckband wireless headset needs to be charged, for example, when the neckband wireless headset has a comparatively low battery level or is powered off due to power exhaustion, the first interface may be detached from the second interface, and the first interface and/or the second interface may charge the neckband wireless headset.

It should be noted that, in the embodiments of this application, that the first interface is detached from the second interface means that the first interface and the second interface are unplugged, the first interface is fully exposed, and the first interface is not electrically connected to the second interface.

For example, in one case, the user may unplug the first interface and the second interface that are plugged together, so that the first interface is fully exposed, and the first interface is not electrically connected to the second interface. In another case, a switch is disposed on the neckband wireless headset. When the user presses the switch, the first interface pops off the second interface, so that the first interface is fully exposed, and the first interface is not electrically connected to the second interface. In another case, the user indicates to detach the first interface from the second interface on the mobile phone that sends audio data of the music to the neckband wireless headset, and the mobile phone sends a detachment indication to the neckband wireless headset after detecting an indication operation of the user. The neckband wireless headset automatically enables the first interface to pop off the second interface in response to the detachment indication, so that the first interface is fully exposed, and the first interface is not electrically connected to the second interface.

After the first interface 401 is detached from the second interface 402, the neckband wireless headset may include a first headset part 404 and a second headset part 403 shown in FIG. 4. The first headset part 404 may include the first earplug 301, the first connection cable 305, the battery box 303, the second connection cable 306, and a first part 421 of the cable control box 304 that are electrically connected in sequence. The first part 421 of the cable control box 304 may include the control module 309 electrically connected to the second connection cable 306, and the first interface 401 electrically connected to the control module 309. In this way, the first interface 401 is also electrically connected to the second connection cable 306. The second headset part 403 may include the second earplug 302, the third connection cable 307, and a second part 422 of the cable control box 304 that are electrically connected in sequence. The second part 422 of the cable control box 304 may include the second interface 402.

In the embodiments of this application, the first interface and the second interface may be specifically a plurality of different pluggable interfaces. For example, the first interface is a male connector, and the second interface is a female connector. In the following embodiment, an example in which the first interface is a male connector (refer to the interface 401 in FIG. 4) of a USB Type-C connector (USB-C for short) and the second interface is a female connector (refer to the interface 402 in FIG. 4) of the USB-C connector is used for description.

In an embodiment, after the first interface is detached from the second interface, the first interface (namely, the male connector of the USB-C connector) may be electrically connected to an external power supply to charge the first battery. When the first interface is electrically connected to the external power supply, a current input by the external power supply flows in from the first interface, and flows into the first battery in the battery box through the control module and the second connection cable, to charge the first battery.

For example, the first interface may be directly inserted into a female connector of a USB-C connector disposed on an external power supply, such as the mobile phone, an iPad, a mobile power supply, a power plug, or the another electronic device, to perform charging. In this way, an additional charging cable and a dedicated power supply are not required. The second connection cable and the first connection cable of the neckband wireless headset may be used as a charging cable, and the mobile phone or another portable electronic device may be used as the power supply. In this way, the first battery of the neckband wireless headset can be simply, conveniently, and quickly charged. Therefore, in a case in which it is difficult to connect the wireless headset to the power supply during a trip such as on a train, on an airplane, in a car, or outdoors, the neckband wireless headset can also be conveniently charged.

In particular, the first interface may be inserted into an electronic device that is being used in cooperation with the neckband wireless headset for charging. In this way, a quantity of devices connected to each other (including a wired connection and a wireless connection) can be reduced, and a quantity of devices that the user needs to carry when moving can be reduced. For example, in a scenario shown in FIG. 6, in comparison with a scenario in which the first interface is inserted into another electronic device such as the iPad, the mobile power supply, or the like, or the power plug to perform charging, as shown in FIG. 7A, the first interface 401 is inserted into the mobile phone to perform charging, so that the quantity of devices connected to each other can be reduced. The user does not need to carry the iPad or the mobile power supply when moving, and only needs to carry the neckband wireless headset or carry the neckband wireless headset and the mobile phone.

The following uses an example, in which the first interface is inserted into the mobile phone to perform charging when the neckband wireless headset and the mobile phone are used, for description. There may be a plurality of specific implementations in which the first interface charges the first battery of the first headset part through the mobile phone.

For example, in a solution, when the first interface (that is, the male connector of the USB-C connector) is inserted into the female connector of the USB-C connector of the mobile phone, the processor may send a device type (for example, a headset type) to the mobile phone through the first interface. After determining that a connected device is of the headset type, the mobile phone charges the first battery through the first interface.

In another solution, after the first interface is inserted into the female connector of the USB-C connector of the mobile phone, the mobile phone may compare a voltage of a battery of the mobile phone with a voltage of the first battery connected to the first interface. If the voltage of the battery of the mobile phone is higher than the voltage of the first battery, the mobile phone may charge the first battery through the first interface. If the voltage of the battery of the mobile phone is lower than the voltage of the first battery, the mobile phone does not charge the first battery.

In another solution, after the first interface is inserted into the female connector of the USB-C connector of the mobile phone, the mobile phone may compare a voltage of a battery of the mobile phone with a voltage of the first battery connected to the first interface. If the voltage of the battery of the mobile phone is higher than the voltage of the first battery, the mobile phone may charge the first battery through the first interface. If the voltage of the battery of the mobile phone is lower than the voltage of the first battery, the mobile phone charges the first battery through the first interface after increasing the voltage of the first battery.

In another solution, after the first interface is inserted into the female connector of the USB-C connector of the mobile phone, the mobile phone may compare a value relationship between a voltage of a battery of the mobile phone and a preset threshold. Usually, when a battery level is adequate, a voltage of the battery is comparatively high. For example, when the battery level is adequate, the voltage of the battery of the mobile phone may be 4.2 V. When the battery level decreases, the voltage of the battery also decreases. Therefore, if the voltage of the battery of the mobile phone is higher than the preset threshold (for example, may be 3.7 V), it may indicate that the battery level of the mobile phone is adequate, and the mobile phone may charge the first battery through the first interface. If the voltage of the mobile phone battery is lower than the preset threshold, it may indicate that the battery level of the mobile phone is inadequate, and the mobile phone may not charge the first battery.

In another example solution, when the first interface 401 is inserted into the female connector of the USB-C connector of the mobile phone, referring to FIG. 7A, the mobile phone may display a prompt interface 71 on a current interface to prompt the user whether to charge the connected neckband wireless headset. Alternatively, the mobile phone may prompt, through a related application (App), the user whether to charge the connected neckband wireless headset. Alternatively, the mobile phone may prompt, through a voice, the user whether to charge the connected neckband wireless headset. After detecting an operation performed by the user to indicate to charge (for example, detecting that the user taps a control 72 or detecting a voice instruction of the user), the mobile phone charges the first battery through the first interface 401.

In another example solution, after the first interface is inserted into the female connector of the USB-C connector of the mobile phone, the user may press a control 2 on the neckband wireless headset. The neckband wireless headset sends a charging request to the mobile phone, and after receiving the charging request, the mobile phone charges the first battery through the first interface.

In another example solution, after the first interface is inserted into the female connector of the USB-C connector of the mobile phone, the user may indicate, through a microphone of the mobile phone, the mobile phone to charge the neckband wireless headset. After detecting the indication, the mobile phone charges the first battery through the first interface.

In another example solution, after the first interface is inserted into the female connector of the USB-C connector of the mobile phone, the user may indicate, through the microphone of the neckband wireless headset, the mobile phone to charge the neckband wireless headset. The processor sends indication information to the mobile phone through the first interface, or the processor sends the indication information to the mobile phone through the first Bluetooth chip. After receiving the indication information, the mobile phone charges the first battery through the first interface.

In some embodiments, after the first interface is inserted into the mobile phone, in addition to charging the first battery, the first interface may further determine whether Bluetooth pairing has been performed between the first Bluetooth chip of the neckband wireless headset and the mobile phone. If the Bluetooth pairing has not been performed, the first Bluetooth chip may be further triggered to perform Bluetooth pairing with the mobile phone. Therefore, when the user subsequently wants to use the first Bluetooth chip to perform Bluetooth communication with the mobile phone, the user may directly perform Bluetooth connection and the Bluetooth communication based on the pairing, instead of performing the Bluetooth pairing when the user needs to use the Bluetooth communication.

Figure 7B:
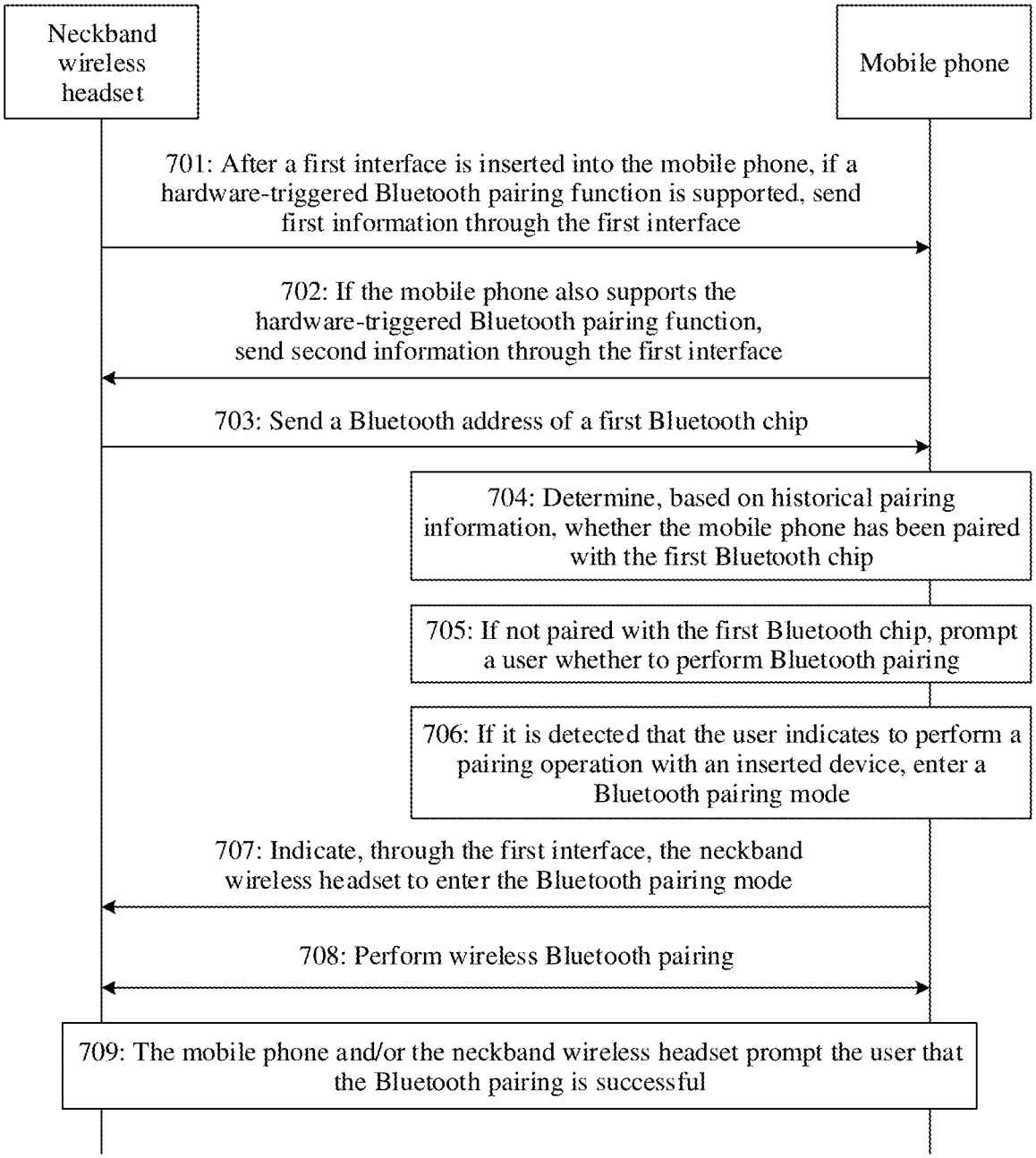
FIG. 7B is a flowchart of triggering of Bluetooth pairing according to an embodiment of this application.

For example, referring to FIG. 7B, a process of triggering the Bluetooth pairing may include the following steps. 701: After a first interface is inserted into a mobile phone, if a processor of a neckband wireless headset determines to support a hardware-triggered Bluetooth pairing function, the processor may control the first interface to send first information to the mobile phone, where the first information is used to indicate that the neckband wireless headset supports the hardware-triggered Bluetooth pairing function. 702: After receiving the first information, if determining that the mobile phone also supports the hardware-triggered Bluetooth pairing function, the mobile phone sends second information to the neckband wireless headset through the first interface, to notify the neckband wireless headset that the mobile phone also supports the hardware-triggered Bluetooth pairing function. 703: After receiving the second information, the neckband wireless headset may send information such as a Bluetooth address (for example, a MAC address) of a first Bluetooth chip to the mobile phone. 704: Historical pairing information of the mobile phone stores a Bluetooth address of a device that has been paired with the mobile phone, and the mobile phone may determine, based on whether the historical pairing information includes the Bluetooth address of the first Bluetooth chip, whether the mobile phone has been paired with the first Bluetooth chip. 705: If the mobile phone is not paired with the first Bluetooth chip, the mobile phone may prompt a user whether to perform Bluetooth pairing with an inserted device. 706: If the mobile phone detects that the user indicates to perform a pairing operation with the inserted device, the mobile phone may enter a Bluetooth pairing mode. 707: The mobile phone may indicate, through the first interface, the neckband wireless headset to enter the Bluetooth pairing mode. 708: The mobile phone may directly perform wireless Bluetooth pairing with the first Bluetooth chip based on the Bluetooth address of the first Bluetooth chip that is obtained through the first interface. A Bluetooth pairing process may comply with an existing Bluetooth protocol. This is not limited in embodiments of the present disclosure. 709: After the Bluetooth pairing is completed, the mobile phone and/or the neckband wireless headset may prompt the user that the Bluetooth pairing succeeds. In addition, the mobile phone may further display related information such as names and Bluetooth addresses of the two devices that are successfully paired.

It should be noted that, when step 701 to step 709 are performed, the headset keeps powered on. In some implementations, in step 702, if the mobile phone determines that the mobile phone does not support the hardware-triggered Bluetooth pairing function, steps after step 702 are not performed, and the foregoing process in which the first interface is inserted into the mobile phone to perform charging is performed. Alternatively, in step 704, if the mobile phone determines that the mobile phone has been paired with the headset before step 701, steps after step 704 are not performed, and the foregoing process in which the first interface is inserted into the mobile phone to perform charging is performed. Alternatively, after step 709 is performed, the foregoing process in which the first interface is inserted into the mobile phone to perform charging is performed. A specific charging process is not repeated. During charging, the headset may keep powered on or powered off.

In other words, that the first interface is inserted into the mobile phone may trigger the mobile phone to perform Bluetooth pairing with the first Bluetooth chip by hardware. In comparison with a process that is of triggering Bluetooth pairing by wireless software such as wireless scanning and that is in prior art, that the Bluetooth pairing is triggered by the hardware can save complex operations such as indicating, by the user, to enter the Bluetooth pairing mode and selecting a to-be-paired device, so that the Bluetooth pairing process is simpler and faster.

In addition, after the first interface is detached from the second interface, at least first headset part in the neckband wireless headset may still be used when the neckband wireless headset is charged through the first interface. In this way, when the mobile phone and the neckband wireless headset are used to listen to the music, even if there is a power socket at home and the first interface is inserted into the mobile phone to perform charging, inconvenience caused because the user needs to stay near the power socket for a long time to use the neckband wireless headset can also be avoided. During a trip, the first interface is inserted into the mobile phone to perform charging, so that when the mobile phone and the neckband wireless headset are used, charging can be performed at the same time. This avoids inconvenience caused because the neckband wireless headset needs to be additionally connected to a mobile power supply.

After the first interface is detached from the second interface, when charging is performed through the first interface, in a solution, referring to FIG. 7A, the first earplug that keeps connected to the first interface may continue to be used. The second earplug that is detached from the first interface cannot continue to be used because power cannot be supplied to the second earplug. In this case, a neckband dual-ear wireless headset becomes a single-ear headset.

Specifically, the first interface may receive, through a connection (that is, the wired connection) between the first interface and the mobile phone, the audio data of the music sent by the mobile phone. The processor invokes the audio management module to send the audio data to the first earplug, and the first earplug plays the audio data. In this case, the first headset part may be used as a wired headset. Alternatively, when the processor determines that channel quality of Bluetooth wireless connection between the headset and the mobile phone is comparatively good (for example, higher than or equal to a preset value), the first Bluetooth chip may receive the audio data in a wireless communication manner, the processor invokes the audio management module to send the audio data to the first earplug, and the first earplug plays the audio data. When the processor determines that the channel quality of the Bluetooth wireless connection between the headset and the mobile phone is comparatively poor (for example, lower than the preset value), the first interface receives the audio data of the music in a wired connection manner, and the first earplug plays the audio data.

There may be a plurality of parameters used to indicate the channel quality, for example, one or more of a packet loss rate, a packet error rate, a signal-to-noise ratio, a quality of service (QoS) parameter, or a channel quality indicator (CQI) parameter. In a process in which the neckband wireless headset performs Bluetooth communication with the mobile phone, the first Bluetooth chip may obtain the channel quality parameter through the antenna, and report the channel quality parameter to the processor. The processor may determine the channel quality based on the channel quality parameter.

In this solution, after the first interface is detached from the second interface, the second earplug stops working. After the first interface is inserted into the mobile phone, the processor controls the first headset part to be powered off, and the mobile phone may stop playing the music and record a playing point at which the music is stopped playing. After the user indicates the first headset part to be powered on, the first earplug starts to work, the mobile phone continues to send the audio data of the music to the first headset part from the playing point, and the user may continue to enjoy the music through the first earplug. Alternatively, after the first interface is inserted into the mobile phone, the first headset part is not powered off, and the first earplug continues to play the music after the first interface is inserted into the mobile phone. Alternatively, before the first interface is inserted into the mobile phone, if the first earplug plays the left sound channel signal or the right sound channel signal in the dual sound channel signal, the processor enables, by invoking the audio management module, the first earplug to play the mono sound channel signal after the first interface is inserted into the mobile phone, to improve user experience.

After the first interface is detached from the second interface, when charging is performed through the first interface, in another example solution, the first earplug connected to the first interface may be used as normal. In addition, a second Bluetooth chip and a second battery may be installed in the second earplug, the second battery may supply power to the second headset part, and the second earplug in the second headset part may also be used.

Specifically, after the first interface is detached from the second interface, when the first interface is not electrically connected to a charging device, the second battery may supply power to the second headset part if the first headset part is not electrically connected to the second headset part. If the first headset part is electrically connected to the second headset part, the second battery may supply power to the second headset part and the first headset part.

When the first interface is not detached from the second interface, in one case, the first earplug and the second earplug may share the first Bluetooth chip. In another case, the first earplug performs wireless communication with the mobile phone through the first Bluetooth chip, and the second earplug performs wireless communication with the mobile phone through the second Bluetooth chip. After the first interface is detached from the second interface, the first earplug performs the wireless communication with the mobile phone through the first Bluetooth chip, and the second earplug performs the wireless communication with the mobile phone through the second Bluetooth chip.

The first Bluetooth chip and the second Bluetooth chip may be paired before delivery, and the first Bluetooth chip and the second Bluetooth chip store Bluetooth addresses of each other. The first Bluetooth chip and the second Bluetooth chip may establish a Bluetooth connection based on the saved Bluetooth addresses of each other. Alternatively, the first Bluetooth chip and the second Bluetooth chip are paired and connected when the first interface is detached from the second interface and the second earplug is used in a Bluetooth manner.

Figure 8:
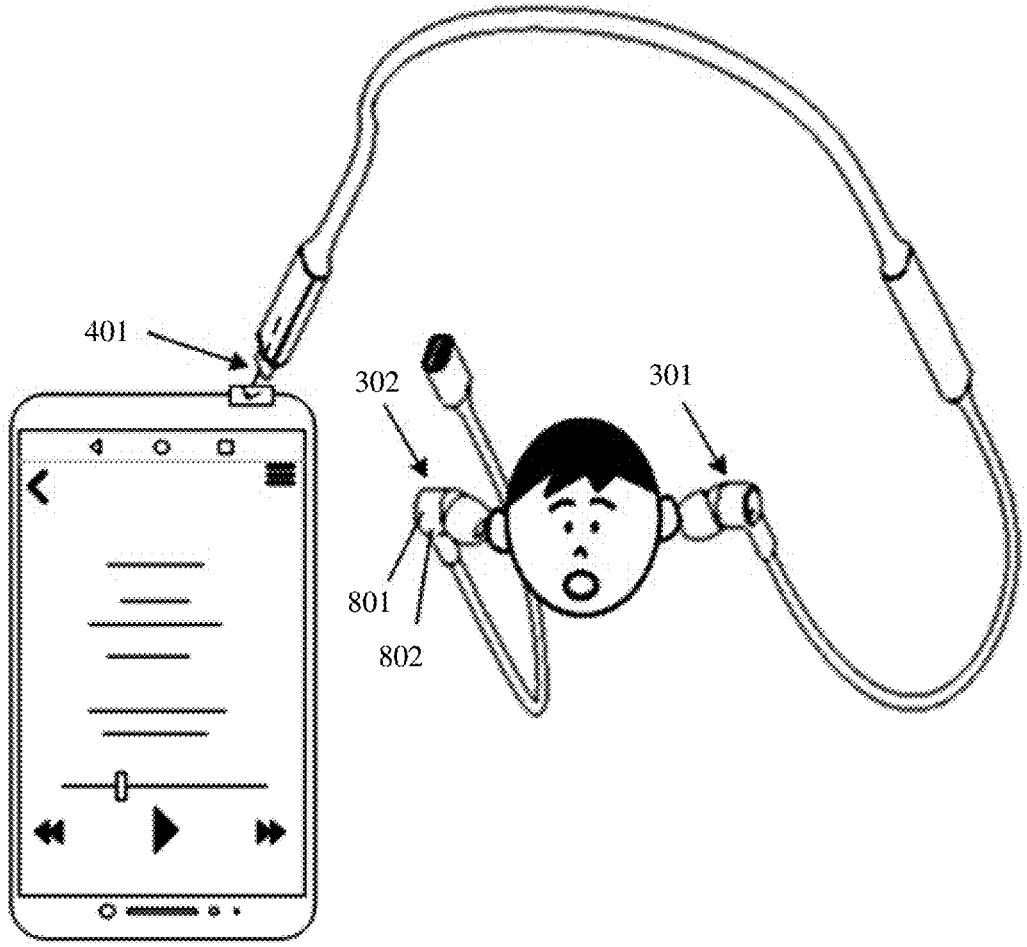
FIG. 8 is a schematic diagram of another scenario according to an embodiment of this application.

After the first interface is detached from the second interface, when charging is performed through the first interface, the first earplug and the second earplug may be used together in a double-ear mode, and the first earplug and the second earplug synchronously play the music. For example, referring to FIG. 8, a same user wears both the first earplug 301 and the second earplug 302. The second earplug 302 includes a second Bluetooth chip 801 and a second battery 802, and the first earplug 301 and the second earplug 302 synchronously play left sound channel and right sound channel signals of stereo music. Specifically, the first earplug may establish a forwarding connection, a listening connection, or a dual-sending connection to a Bluetooth chip of a mobile phone through the first Bluetooth chip, and the second earplug may establish a forwarding connection, a listening connection, or a dual-sending connection to the Bluetooth chip of the mobile phone through the second Bluetooth chip, to synchronously play the music. For related descriptions of a dual-sending connection solution, refer to related descriptions in application documents whose application numbers are PCT/CN2018/118783, PCT/CN2018/118730, and PCT/CN2018/118791.

Figure 9:
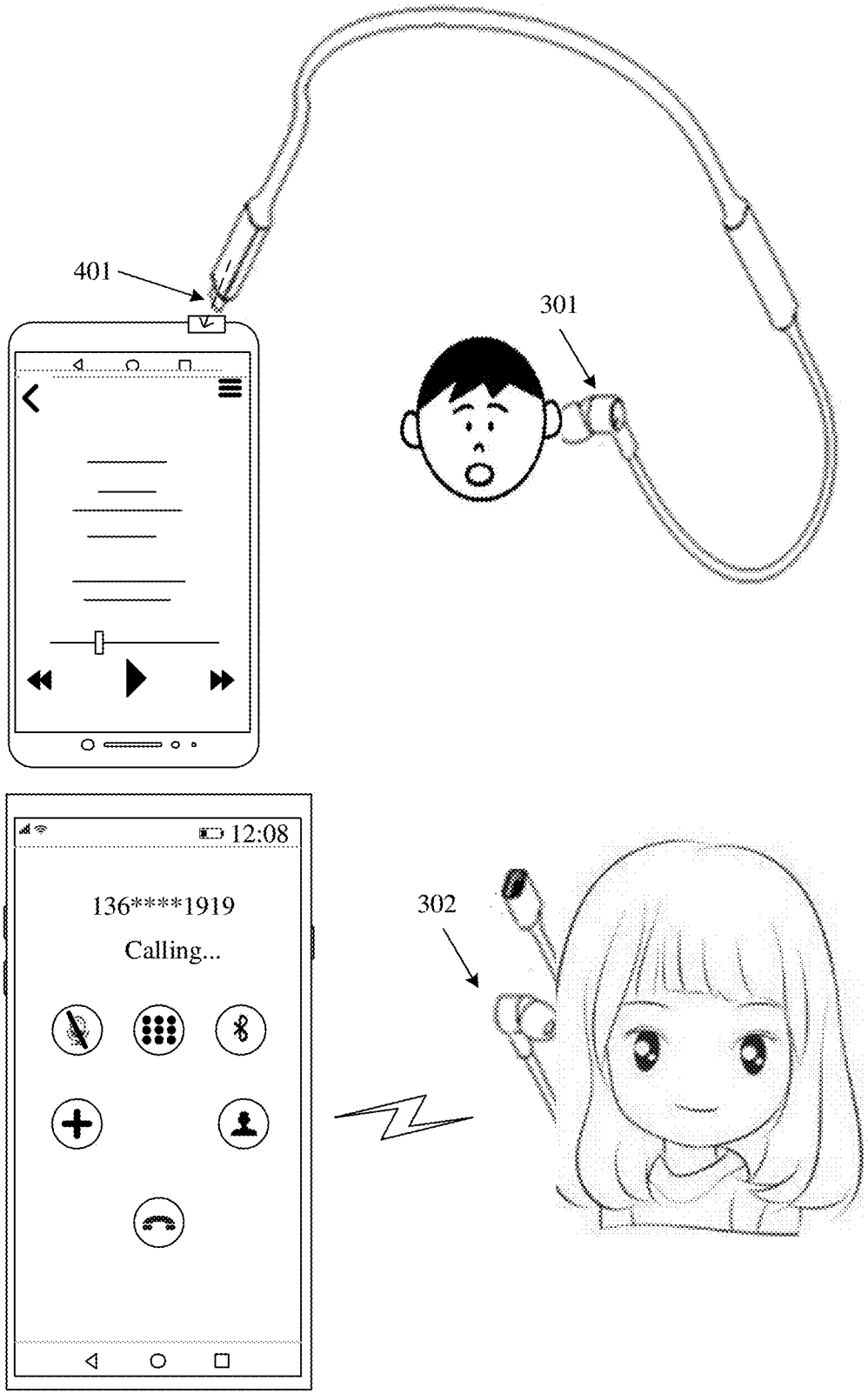
FIG. 9 is a schematic diagram of another scenario according to an embodiment of this application.

Alternatively, the first earplug and the second earplug may be separately used in a single-ear mode. For example, referring to FIG. 9, different users use different earplugs to connect to different mobile phones for use. For example, the current user continues to use the first earplug and the current mobile phone to enjoy the music. The second earplug establishes a Bluetooth connection to a Bluetooth chip of another mobile phone through the second Bluetooth chip, and another user uses the second earplug and the another mobile phone to make a call.

Alternatively, the first earplug is wiredly connected to the mobile phone through the first interface, to receive and play the audio data of the music. In this case, the first headset part may be used as the wired headset. Alternatively, when channel quality of a Bluetooth wireless connection between the first earplug and the mobile phone is comparatively good, the first earplug receives the audio data in a Bluetooth wireless communication manner, to play the music. When the channel quality of the Bluetooth wireless connection is comparatively poor, the first earplug receives the audio data through the first interface in a wired connection manner, to play the music. The second earplug may establish a Bluetooth connection to the mobile phone through the second Bluetooth chip, to receive and play the audio data of the music in a wireless manner. In this case, the second headset part may be used as the wireless headset. In this case, the first earplug and the second earplug may be used together in the double-ear mode to synchronously play the music, or may be separately used in the single-ear mode. This is not limited in the embodiments of this application.

In a case in which the second battery is installed in the second earplug and the first interface is not detached from the second interface, according to a preset policy, only the first battery supplies power to the neckband wireless headset, and the second battery does not supply power to the neckband wireless headset. Therefore, after the first interface is detached from the second interface, the second earplug may continue to work by using power of the second battery. Alternatively, the first battery first supplies power to the neckband wireless headset, and when the first battery has no power or has comparatively low power, the second battery supplies power to the neckband wireless headset. Alternatively, both the first battery and the second battery may supply power to the neckband wireless headset. In addition, the first battery and the second battery may further charge each other based on different voltages of each other, so that voltages of the two batteries tend to be balanced. Alternatively, when the power of the first battery is exhausted or is about to be exhausted, the second battery may charge the first battery.

In a case in which the second battery is installed in the second earplug, the first headset part may also be electrically connected to the second headset part through a connection component when the first interface is detached from the second interface, and the first interface is connected to the mobile phone to charge the first battery, so that the first battery and the second battery may be charged at the same time. In addition, a wiring terminal, a power sourcing control chip, a temperature detection circuit, and the like that are used in cooperation with the second battery may be further disposed in the second earplug. In this case, a current input by the mobile phone flows in from the first interface, and flows into the first battery in the battery box through the control module and the second connection cable, to charge the first battery. The current flowing in from the first interface may also flow into the second headset part through the connection component between the first headset part and the second headset part, and then flow into the second battery in the second headset part. Therefore, the current may also charge the second battery.

Figure 10:
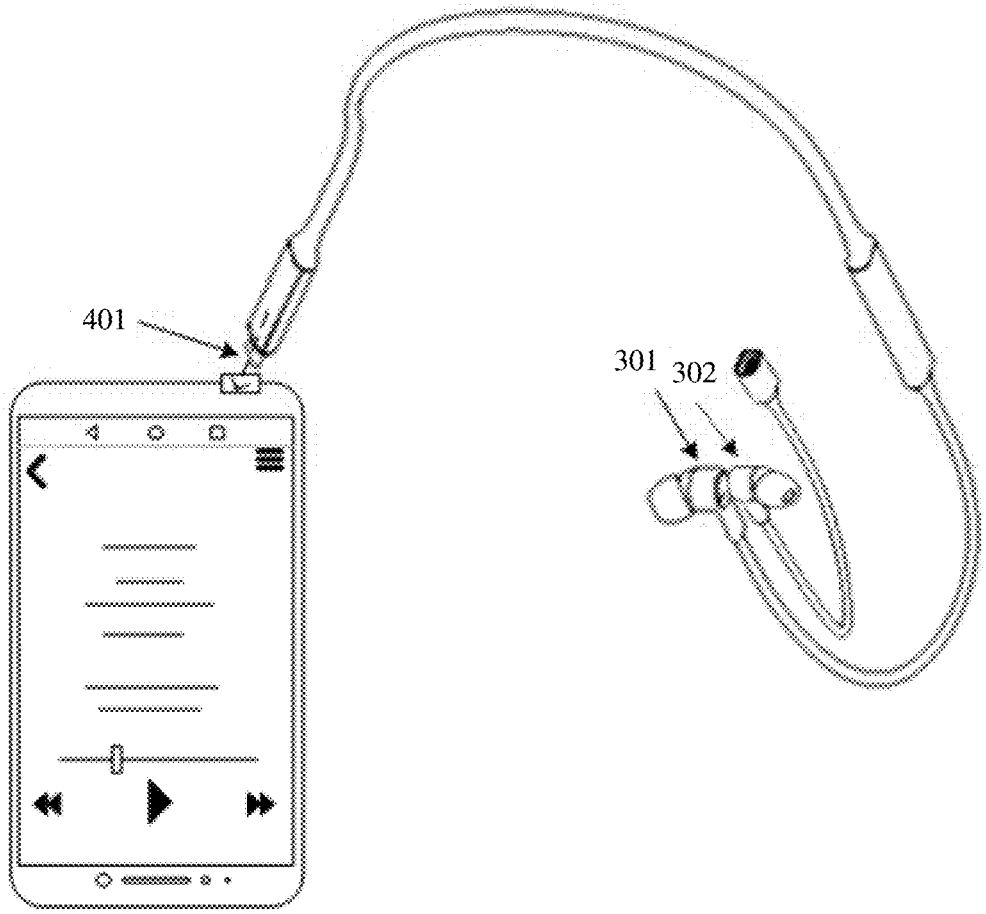
FIG. 10 is a schematic diagram of another charging manner of a wireless headset according to an embodiment of this application.

For example, referring to FIG. 10, a magnetic attachment component (for example, an induction spring plate) is separately disposed on a back surface of the first earplug and a back surface of the second earplug. When the back surface of the first earplug and the back surface of the second earplug are close to each other, a first induction spring plate on the back surface of the first earplug is connected to a second induction spring plate on the back surface of the second earplug through magnetic attachment, in other words, the first headset part is electrically connected to the second headset part. The charging current flowing in from the first interface may flow into the second battery in the second earplug through an electrical connection between the first induction spring plate and the second induction spring plate. Therefore, the current may also charge the second battery.

For another example, the first interface is electrically connected to a first connection plug, the second interface is electrically connected to a second connection plug, and the first connection plug is detachably connected to the second connection plug. When the first interface is not detached from the second interface, the first connection plug and the second connection plug may be plugged together to keep the electrical connection, or may be detached to break the electrical connection. After the first interface is detached from the second interface, the first connection plug and the second connection plug are plugged together. The charging current flowing in from the first interface may flow into the second battery in the second earplug through the first connection plug and the second connection plug that are electrically connected. Therefore, the current may also charge the second battery.

For another example, the neckband wireless headset may further include a jumper, and the first interface and the second interface are electrically connected through the jumper. After the first interface is detached from the second interface, the charging current flowing in from the first interface may flow into the second interface through the jumper, and then flow into the second battery in the second earplug. Therefore, the current may also charge the second battery.

It may be understood that the first headset part and the second headset part may also be electrically connected in another manner such as a card fastener, to charge the first battery in the first headset part and the second battery in the second headset part through the first interface. The foregoing components such as the first induction spring plate, the second induction spring plate, the jumper, the first connection plug, the second connection plug, and the card fastener are connection components between the first headset part and the second headset part.

It should be noted that, after the first interface is detached from the second interface, when charging is performed through the first interface, usually, a distance at which the first earplug and the second earplug are attached together or an extendable distance between the first earplug and the second earplug is limited due to limitation of a connection manner between two headset units if the first headset part is electrically connected to the second headset part. Therefore, the user can usually wear only one earplug into an ear, in other words, the user can only choose to use the first earplug or the second earplug. However, both the first earplug and the second earplug that are electrically connected can receive and play the audio data. If the extendable distance between the first earplug and the second earplug is comparatively long (for example, the two headset units are connected through the jumper), the user may also use the first earplug and the second earplug at the same time.

When the user uses the first earplug and/or the second earplug, the first earplug and/or the second earplug may receive the audio data through a connection (that is, the wired connection) between the first interface and the mobile phone, to play the music. Alternatively, the first earplug and/or the second earplug may receive the audio data through the first Bluetooth chip and/or the second Bluetooth chip in a wireless communication manner, to play the music. When the channel quality of the Bluetooth wireless connection is comparatively good, the first earplug and/or the second earplug may receive the audio data in the wireless communication manner, to play the music. When the channel quality of the Bluetooth wireless connection is comparatively poor, the first earplug and/or the second earplug may receive the audio data in the wired communication manner through the first interface, to play the music.

In another example solution, the first interface may be further connected to another electronic device or a power supply through a conversion adapter, a conversion cable, or the like, to charge the first battery and/or the second battery. For example, the first interface (that is, the male connector of the USB-C connector) may be connected, through a conversion cable with both ends being female connectors of the USB-C connector, to a charging device provided with a male connector, to charge the first battery and/or the second battery.

In another embodiment, after the first interface is detached from the second interface, the second interface is electrically connected to an external power supply to charge the second battery in the second earplug. The external power supply electrically connected to the second interface may be the same as or different from an external power supply electrically connected to the first interface. When the second interface is electrically connected to the external power supply, a current flowing in from the second interface may flow into the second battery in the second earplug through the third connection cable, to charge the second battery. For example, the second interface may be inserted into the external power supply to charge the second battery.

In some embodiments, after the second interface is inserted into the external power supply, in addition to charging the second battery, similar to the procedure shown in FIG. 7B, whether the second Bluetooth chip has performed Bluetooth pairing with the external power supply may be further determined. If the Bluetooth pairing has not been performed, the second Bluetooth chip may be further triggered to perform Bluetooth pairing with the external power supply. Therefore, when the user subsequently wants to use the second Bluetooth chip to perform Bluetooth communication with the external power supply, the user may directly perform Bluetooth connection and the Bluetooth communication based on the pairing, instead of performing the Bluetooth pairing when the user needs to use the Bluetooth communication.

Specifically, the second interface (that is, the female connector of the USB-C connector) may be connected to a male connector of a USB-C connector disposed on the external power supply, or may be connected to the mobile power supply, the power plug, or the another electronic device through the charging cable, the conversion adapter, the conversion cable, or the like, to charge the second battery.

In a scenario in which music is played through the mobile phone, the second earplug may receive, through a wired connection between the second interface and the mobile phone, audio data of the music sent by the mobile phone, and play the audio data. In this case, the second headset part is equivalent to the wired headset. Alternatively, the second earplug may receive, in a wireless connection manner through the second Bluetooth chip, audio data of a voice sent by the mobile phone, and play the audio data. In this case, the second headset part is equivalent to the wireless headset. Alternatively, the processor may determine the channel quality of the Bluetooth connection, and switch between the wired communication manner and the wireless communication manner based on the channel quality.

In this embodiment, the first headset part and the second headset part may further be electrically connected through the connection component. Therefore, when the power supply is connected through the second interface, the second battery in the second headset part may be charged, and the first battery in the first headset part may also be charged. In this case, when the second interface is electrically connected to the external power supply, the current flowing in from the second interface may flow into the second battery in the second earplug through the third connection cable, to charge the second battery. In addition, the current flowing in from the second interface may further flow into the first headset part through the connection component, and then flow into the first battery in the first headset part, to charge the first battery.

Figure 11:
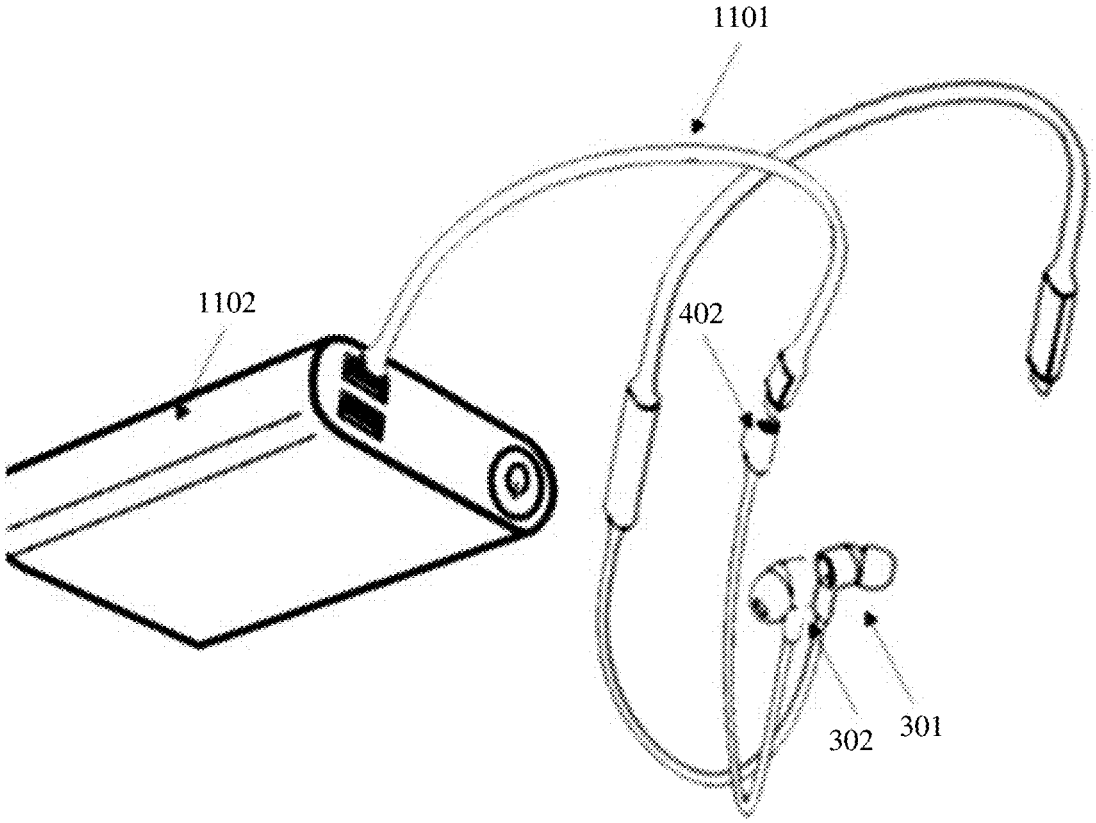
FIG. 11 is a schematic diagram of another charging manner of a wireless headset according to an embodiment of this application.

For example, referring to FIG. 11, the first headset part and the second headset part may be electrically connected through the magnetic attachment components on the back surface of the first earplug and the back surface of the second earplug, and the second interface is connected to a mobile power supply 1102 through a charging cable 1101, to receive charging input. Alternatively, the first headset part and the second headset part may be electrically connected through the jumper between the first interface and the second interface. Alternatively, the first headset part and the second headset part may be electrically connected through the card fastener, a connection plug, or the like.

After the first interface is detached from the second interface, when charging is performed through the second interface and the first headset part is electrically connected to the second headset part, usually, a distance at which the first earplug and the second earplug are attached together or an extendable distance between the first earplug and the second earplug is limited due to limitation of a connection manner between two headset units. Therefore, the user usually can use only one earplug. If the extendable distance between the first earplug and the second earplug is comparatively long, the user may also use the first earplug and the second earplug at the same time. Similarly, when the user uses the first earplug and/or the second earplug, the first earplug and/or the second earplug may receive the audio data in a wired connection manner through the second interface, to play the music. Alternatively, the first earplug and/or the second earplug may receive the audio data in a wireless communication manner through the first Bluetooth chip and/or the second Bluetooth chip, to play the music. Alternatively, the first earplug and/or the second earplug may switch between the wired communication and the wireless communication based on the channel quality.

In another embodiment, after the first interface is detached from the second interface, charging may be performed through the first interface and the second interface at the same time.

Figure 12:
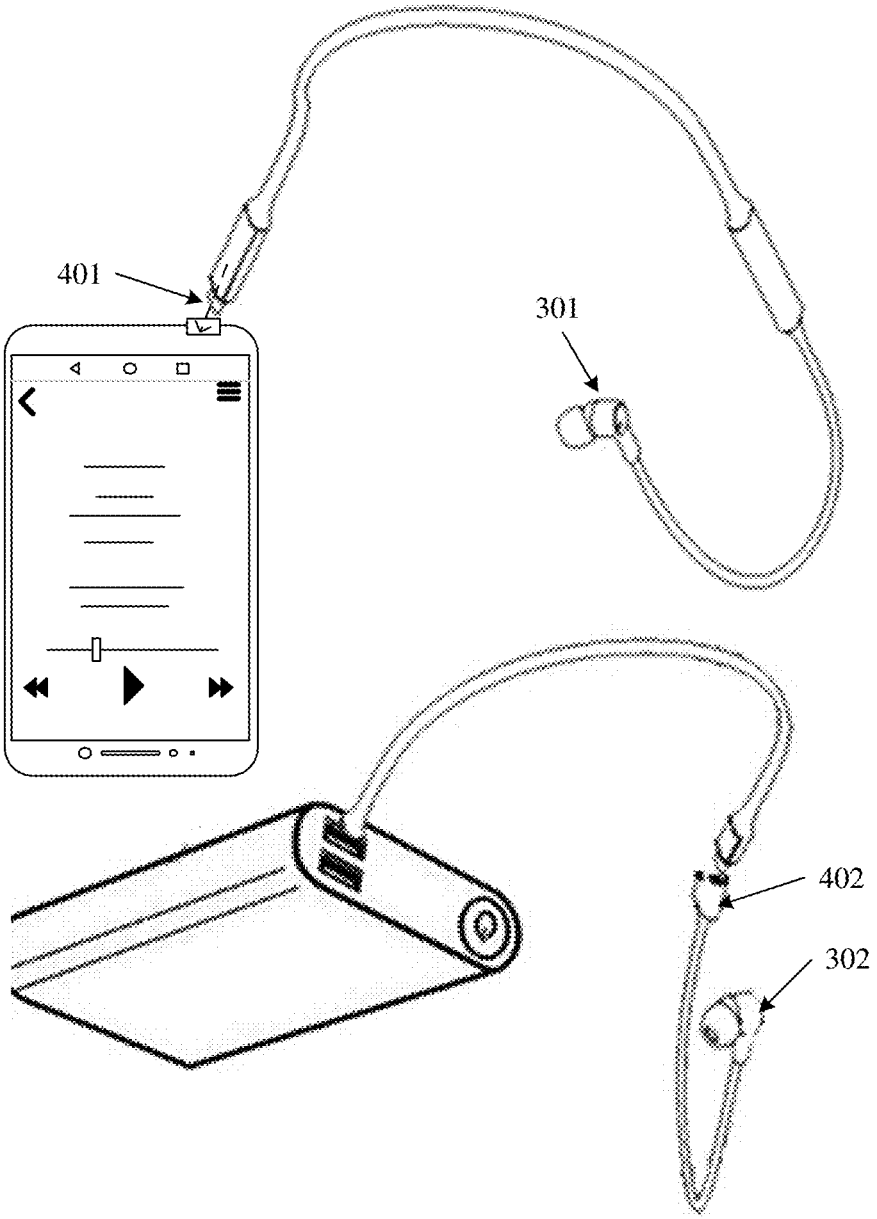
FIG. 12 is a schematic diagram of another charging manner of a wireless headset according to an embodiment of this application.

For example, in a solution, referring to FIG. 12, the first headset part is not electrically connected to the second headset part, the first interface 401 is connected to the mobile phone to charge the first battery, and the second interface 402 is connected to the mobile power supply to charge the second battery. In this case, a current input by the mobile phone to the first interface 401 flows into the first battery, and a current input by the mobile power supply to the second interface 402 flows into the second battery.

In another example solution, the first headset part and the second headset part are electrically connected through the connection component such as the induction spring plate, the jumper, the card fastener, or the connection plug, and are electrically connected to the external power supply through the first interface and the second interface, to perform multi-channel charging on the first battery and the second battery. In this case, a part of a current input by the external power supply to the first interface flows into the first battery, and the other part of the current flows into the second headset part through the connection component and then flows into the second battery in the second headset part. A part of a current input by the external power supply to the second charging interface flows into the second battery, and the other part of the current flows into the first headset part through the connection component and then flows into the first battery in the first headset part. When a maximum charging current of a battery is fixed, the multi-channel charging may make each charging current comparatively small. This can reduce heat generated during charging and improve charging efficiency.

Figure 13:
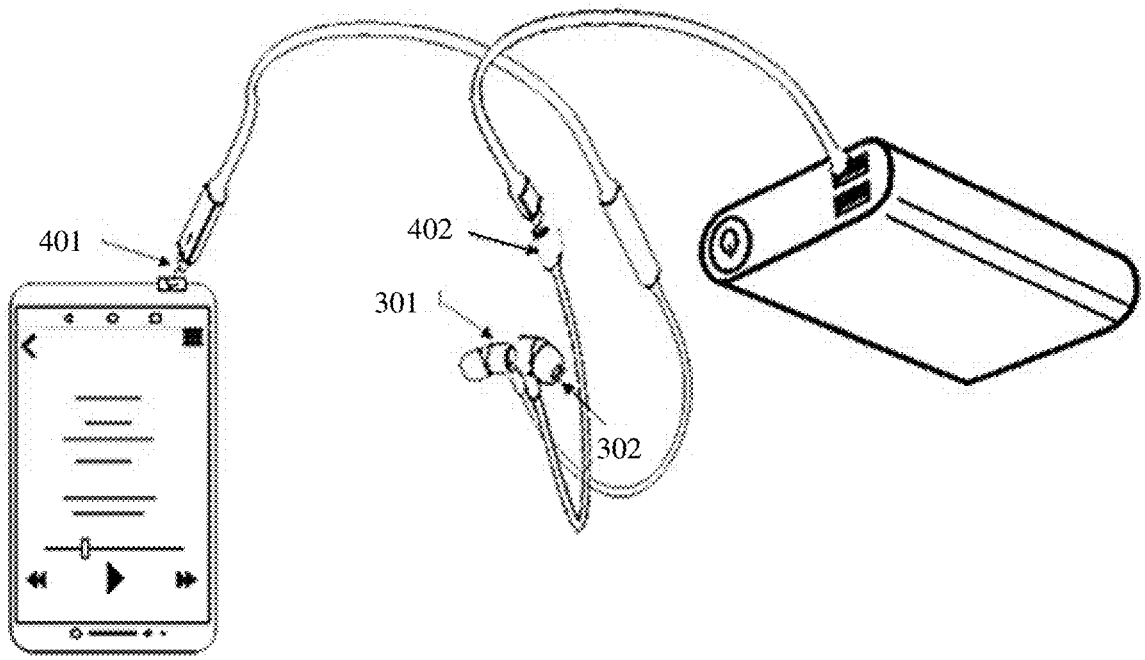
FIG. 13 is a schematic diagram of another charging manner of a wireless headset according to an embodiment of this application.
Figure 14:
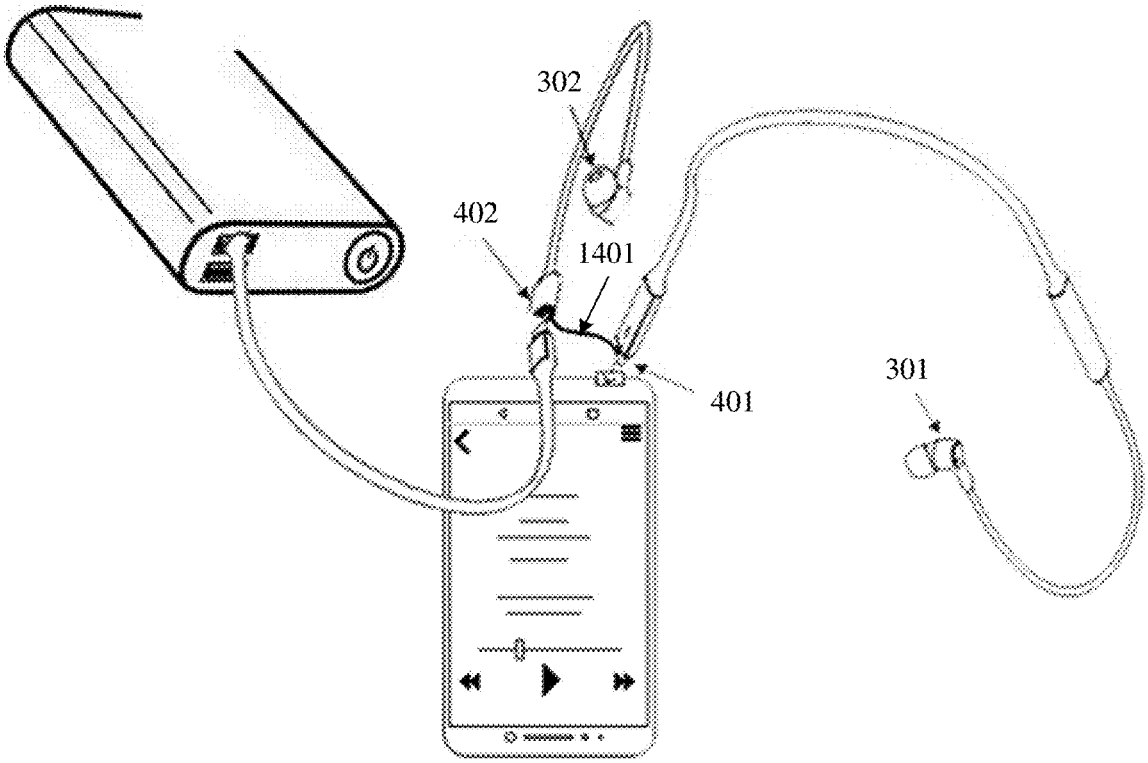
FIG. 14 is a schematic diagram of another charging manner of a wireless headset according to an embodiment of this application.

For example, referring to FIG. 13, the first earplug 301 is connected to the second earplug 302 through a magnetic attachment, the first interface 301 receives the charging input through the mobile phone, and the second interface 302 receives the charging input through the mobile power supply. For another example, referring to FIG. 14, the first interface 401 is connected to the second interface 402 through a jumper 1401, the first interface 401 receives the charging input through the mobile phone, and the second interface 402 receives the charging input through the mobile power supply.

In this solution, when the first headset part is electrically connected to the second headset part through the magnetic attachment, the jumper, the card fastener, a socket, or the like, usually, a distance at which the first earplug and the second earplug are attached together or an extendable distance between the first earplug and the second earplug is limited due to limitation of a connection manner between two headset units. Therefore, the user usually can use only one earplug. If the extendable distance between the first earplug and the second earplug is comparatively long, the user may also use the first earplug and the second earplug at the same time. Similarly, when the user uses the first earplug and/or the second earplug, the first earplug and/or the second earplug may receive the audio data in a wired connection manner through the first interface and/or the second interface, to play music. Alternatively, the first earplug and/or the second earplug may receive the audio data in a wireless communication manner through the first Bluetooth chip and/or the second Bluetooth chip, to play the music. Alternatively, the first earplug and/or the second earplug may switch between the wired communication and the wireless communication based on the channel quality.

Figure 15:
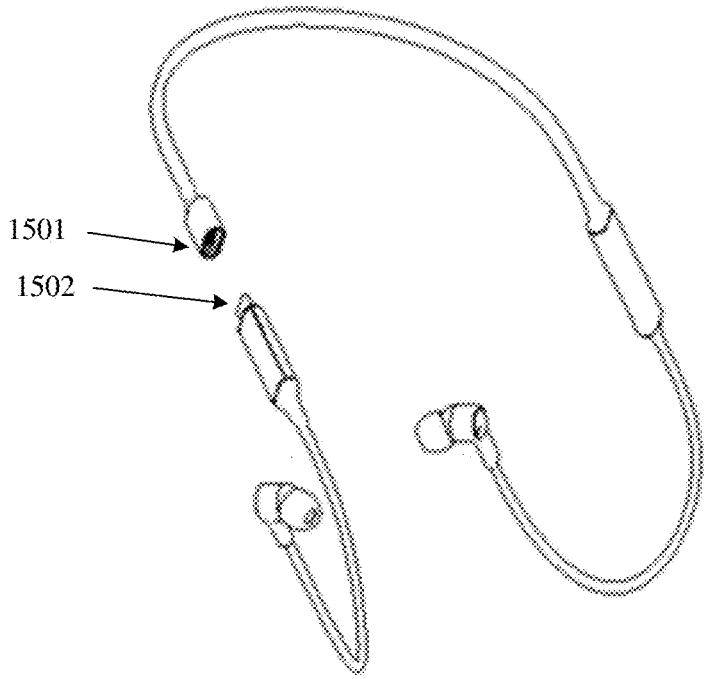
FIG. 15 is a schematic diagram of another wireless headset according to an embodiment of this application.

The foregoing uses an example in which the first interface is a male connector and the second interface is a female connector for description. In other embodiments, the first interface may also be the female connector, and the second interface may also be the male connector. For example, referring to FIG. 15, the first interface is a female connector 1501 of a USB-C connector, and the second interface is a male connector 1502 of the USB-C connector. The first battery and/or the second battery in the neckband wireless headset may still be connected to the another electronic device, the mobile power supply, or the power plug through the first interface and/or the second interface, to perform charging.

In addition, the first interface and the second interface may further charge the another electronic device. When the first headset part is detached from the second headset part, if the first interface is electrically connected to the another electronic device, the first battery may charge the another electronic device through the first interface. Alternatively, if the second interface is electrically connected to the another electronic device, the second battery may charge the another electronic device through the second interface. In a case in which the first headset part is electrically connected to the second headset part, but the first interface is detached from the second interface, if the first interface is electrically connected to the another electronic device, the first battery and/or the second battery may charge the another electronic device through the first interface. If the second interface is electrically connected to the another electronic device, the first battery and/or the second battery may also charge the another electronic device through the second interface.

In other words, when the first interface or the second interface is electrically connected to the another electronic device, the another electronic device may charge the neckband wireless headset, or may receive charging input from the neckband wireless headset. The electronic device and the neckband wireless headset may specifically perform a charging (that is, receiving charging input from another device) operation or a reverse charging (that is, charging the another device) operation according to different preset policies.

An example in which the neckband wireless headset is connected to the mobile phone through the first interface is still used for description.

In an example solution, the male connector of the USB-C connector is disposed on the mobile phone. After the male connector of the USB-C connector of the mobile phone is inserted into the first interface, the processor invokes the power management module to receive charging input from the mobile phone by default. After detecting an operation that the user indicates to charge the mobile phone (for example, the touch sensor detects that the user touches a second control on the neckband wireless headset, or the microphone detects the voice instruction of the user), the processor invokes the power management module to perform a reverse charging function.

In another example solution, after the male connector of the USB-C connector of the mobile phone is inserted into the first interface, the mobile phone may compare the voltage of the battery of the mobile phone with the voltage of the first battery connected to the first interface. If the voltage of the battery of the mobile phone is lower than the voltage of the first battery, the mobile phone may receive the charging input from the neckband wireless headset through the first interface. Otherwise, the mobile phone may charge the first battery through the first interface.

Figure 16:
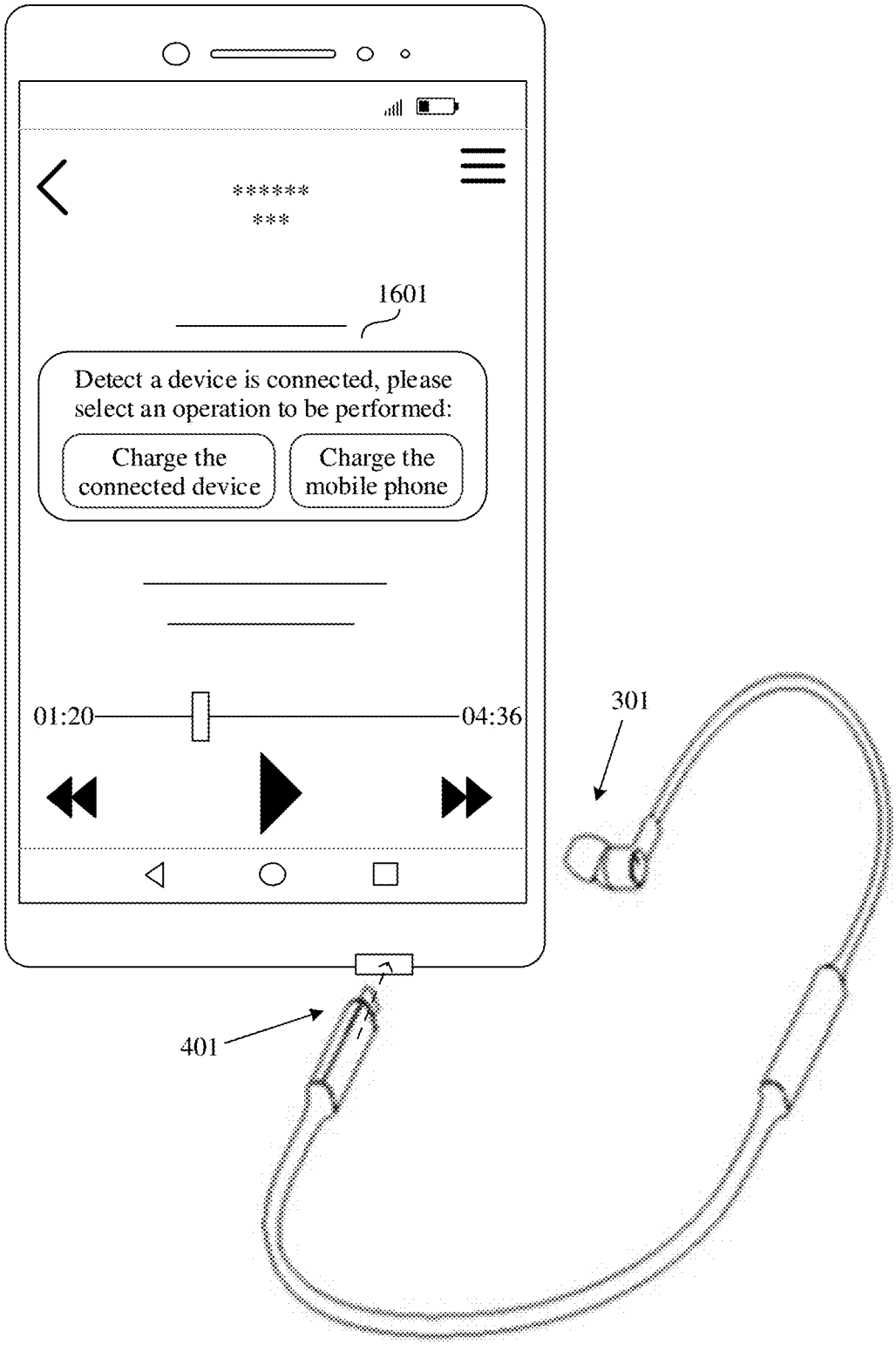
FIG. 16 is a schematic diagram of another scenario according to an embodiment of this application.

In another example solution, after the male connector of the USB-C connector of the mobile phone is inserted into the first interface, referring to FIG. 16, the mobile phone may display a prompt interface 1601 on a current interface, prompt the user through a related App, or prompt the user through a voice, whether to charge the connected neckband wireless headset or receive the charging input from the neckband wireless headset. After detecting an indication operation performed by the user on a screen of the mobile phone, or after detecting a voice indication of the user through the microphone, the mobile phone performs a charging operation or an operation of receiving the charging input based on the indication of the user.

In another example solution, after the male connector of the USB-C connector of the mobile phone is inserted into the first interface, the user may touch the second control on the neckband wireless headset, and in response to the touch operation, the first Bluetooth chip or the processor sends a request for supplying power to the mobile phone through the first interface. After receiving the request, the mobile phone receives the charging input of the neckband wireless headset through the first interface.

In still another example solution, after the male connector of the USB-C connector of the mobile phone is inserted into the first interface, the user may indicate, through the microphone of the mobile phone, the mobile phone to receive the charging input from the neckband wireless headset. In response to the indication operation of the user, the mobile phone requests, through the first interface, the neckband wireless headset to charge the mobile phone.

In another example solution, after the male connector of the USB-C connector of the mobile phone is inserted into the first interface, the user may indicate, through the microphone of the neckband wireless headset, the neckband wireless headset to charge the mobile phone. The first Bluetooth chip or the processor sends the indication information to the mobile phone through the first interface in response to the indication operation of the user. After receiving the indication information, the mobile phone receives the charging input from the neckband wireless headset through the first interface.

In another embodiment, on a basis that the first headset part is electrically connected to the second headset part, after being inserted into the external power supply, in addition to charging the first battery and the second battery, the first interface may trigger the first Bluetooth chip and/or the second Bluetooth chip, according to a preset policy or selection of the user, to perform Bluetooth pairing with the external power supply. After being inserted into the external power supply, in addition to charging the first battery and the second battery, the second interface may trigger the first Bluetooth chip and/or the second Bluetooth chip, according to the preset policy or the selection of the user, to perform Bluetooth pairing with the external power supply.

Figure 17:
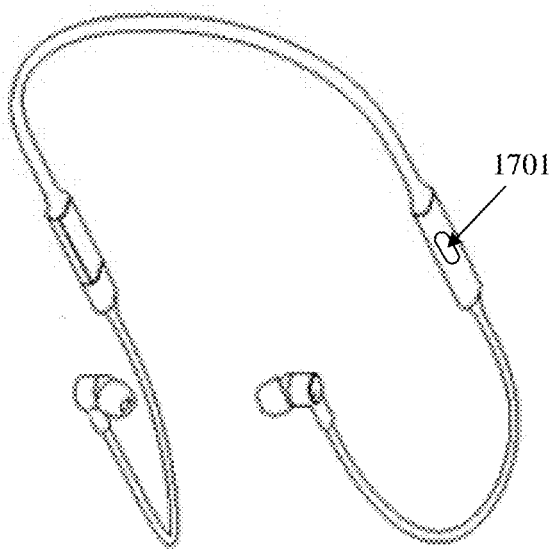
FIG. 17 is a schematic diagram of another wireless headset according to an embodiment of this application.

In another embodiment, a third charging interface may be further disposed on an outer surface of the cable control box or the battery box. The third charging interface is electrically connected to the second connection cable, and the third charging interface may be connected to the mobile power supply, the power plug, or the another electronic device through a charging cable, to charge the neckband wireless headset. In particular, the third charging interface may be located on the outer surface of the cable control box or the battery box, and on a side that is away from a neck of the user, to facilitate connection to the charging cable. For example, referring to FIG. 17, the third charging interface may be a female connector 1701 of a USB-C connector located on the outer surface of the battery box. Specifically, when the first interface is not detached from the second interface, the third charging interface may be used independently to charge the battery of the neckband wireless headset. When the first interface is detached from the second interface, the third charging interface may also be used in cooperation with the first interface and/or the second interface to charge the first battery and/or the second battery.

In another embodiment, a wireless charging coil may be further disposed in the cable control box or the battery box, and may be configured to receive wireless charging input of the another electronic device, to input a charged current to the battery of the neckband wireless headset. Specifically, when the first interface is not detached from the second interface, the wireless charging coil may be used independently to charge the battery of the neckband wireless headset. When the first interface is detached from the second interface, the wireless charging coil may also be used in cooperation with the first interface, the second interface, and/or the third charging interface to charge the first battery and/or the second battery. For example, the battery box includes the wireless charging coil that may charge the first battery. For another example, the cable control box includes the wireless charging coil that may charge the first battery and the second battery when the first headset part is electrically connected to the second headset part through the connection component.

In some other embodiments, the headset connection interface and the first battery are disposed in the battery box, and the control module is disposed in the control box.

In some other embodiments, a component in the cable control box and a component in the battery box may be disposed in a same cavity.

The foregoing uses an example in which the first interface and the second interface are USB-C interfaces for description. The first interface and the second interface may alternatively be another group of pluggable interfaces, such as a micro USB interface or a lightening interface. This is not limited in the embodiments of this application.

In addition, with reference to the foregoing described charging solutions and the fast charging technology that are used for the headset connection interface, the neckband wireless headset can be quickly charged with a comparatively large amount of electricity in a comparatively short period of time. This facilitates the user in using the neckband wireless headset.

In addition, there may be one or more controls on the outer surface of the control box, which are configured to control startup, shutdown, pause, play, previous song, next song, and the like. When the user triggers a control instruction through these controls, the neckband wireless headset performs a corresponding operation.

The foregoing uses a music listening scenario as an example for description. The foregoing charging solution may also be used in another scenario such as a call-making scenario or a video-watching scenario.

The foregoing descriptions about implementations allow a person skilled in the art to understand that clearly, for the purpose of convenient and brief description, division of the foregoing function modules is taken as an example for illustration. In an actual application, the foregoing functions can be allocated to different modules and implemented according to a requirement, that is, an inner structure of an apparatus is divided into different function modules to implement all or some of the functions described above.

In the embodiments described above in this application, it should be understood that the disclosed apparatus and method may be implemented in other manners. For example, the above described apparatus embodiment is merely an example. For example, the module or unit division is merely logical function division and may be another division in an actual implementation. For example, a plurality of units or components may be combined or integrated into another apparatus, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may be one or more physical units, may be located in one place, or may be distributed on different places. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a readable storage medium. Based on such an understanding, the technical solutions of this application essentially, or the part contributing to the prior art, or all or some of the technical solutions may be implemented in the form of a software product. The software product is stored in a storage medium and includes instructions for instructing a device (which may be a single-chip microcomputer, a chip or the like) or a processor to perform all or some of the steps of the methods described in the embodiments of this application. The foregoing storage medium includes: any medium that can store program code, such as a USB flash drive, a removable hard disk, a read-only memory (ROM), a random access memory (RAM), a magnetic disk, or a compact disc.

The foregoing descriptions are merely specific implementations of this application, but are not intended to limit the protection scope of this application. Any variation or replacement within the technical scope disclosed in this application shall fall within the protection scope of this application. Therefore, the protection scope of this application shall be subject to the protection scope of the claims.

What is claimed is:

1. A wireless headset, comprising a first headset part and a second headset part, wherein the first headset part comprises a first earplug, a battery box wiredly connected to the first earplug, and a first part of a cable control box wiredly connected to the battery box, wherein the first part of the cable control box comprises a first interface, a first wireless chip configured to receive and send a wireless signal, and a processor configured to process the wireless signal, and the battery box comprises a first battery; and the second headset part comprises a second earplug and a second part of the cable control box wiredly connected to the second earplug, wherein the second part of the cable control box comprises a second interface;

the first interface is detachably connected to the second interface;

when the first interface is electrically connected to the second interface, a data path is formed between the second earplug and the processor of the first part of the cable control box, and the first battery supplies power to the second earplug; and the first interface is configured to: when being detached from the second interface and being electrically connected to a first external power supply, charge the first battery.

2. The wireless headset according to claim 1, wherein the first external power supply is a first electronic device; the first interface is further configured to: when being detached from the second interface and being electrically connected to the first electronic device, receive first audio data sent by the first electronic device; and the first earplug is configured to play the first audio data.

3. The wireless headset according to claim 1, wherein the first external power supply is a first electronic device; the first wireless chip is further configured to: when the first interface is detached from the second interface, and the first interface is electrically connected to the first electronic device, receive first audio data sent by the first electronic device; and the first earplug is configured to play the first audio data.

4. The wireless headset according to claim 1, wherein the first external power supply is a first electronic device; the first wireless chip is further configured to: when the first interface is detached from the second interface, and the first interface is electrically connected to the first electronic device, establish a wireless connection to the first electronic device;

the processor is further configured to determine whether quality of the wireless connection established between the first wireless chip and the first electronic device is higher than a preset value;

the first interface is further configured to: when the first interface is detached from the second interface and is electrically connected to the first electronic device, if the quality of the wireless connection is lower than the preset value, receive first audio data sent by the first electronic device;

the first wireless chip is further configured to: when the first interface is detached from the second interface, and the first interface is electrically connected to the first electronic device, if the quality of the wireless connection is higher than the preset value, receive the first audio data that is sent by the first electronic device through the wireless connection; and the first earplug is configured to play the first audio data.

5. The wireless headset according to claim 1, wherein the second earplug comprises a second wireless chip and a second battery;

the second wireless chip is configured to: when the first interface is detached from the second interface, establish a wireless connection to an electronic device, and receive second audio data sent by the electronic device;

the second battery is configured to supply power to the second earplug; and the second earplug is configured to play the second audio data.

6. The wireless headset according to claim 1, wherein a back surface of the first earplug comprises a first magnetic attachment component, and a back surface of the second earplug comprises a second magnetic attachment component; and the second interface is configured to: when the second interface is detached from the first interface, the second interface is electrically connected to a second external power supply, and the first magnetic attachment component is electrically connected to the second magnetic attachment component, charge the first battery.

7. The wireless headset according to claim 1, wherein the wireless headset further comprises a first connection plug and a second connection plug, the first interface is electrically connected to the first connection plug, and the second interface is electrically connected to the second connection plug; and the second interface is configured to: when the second interface is detached from the first interface, the second interface is electrically connected to a second external power supply, and the first connection plug is electrically connected to the second connection plug, charge the first battery.

8. The wireless headset according to claim 1, wherein the wireless headset further comprises a jumper, and the first interface is electrically connected to the second interface through the jumper; and the second interface is configured to: when being detached from the first interface and being electrically connected to a second external power supply, charge the first battery.

9. The wireless headset according to claim 1, wherein the battery box further comprises a wireless charging coil, and the wireless charging coil is configured to: when generating an alternating magnetic field with another coil, charge the first battery.

10. The wireless headset according to claim 1, wherein the second earplug comprises a second battery, and the second interface is configured to: when being detached from the first interface and being electrically connected to a second external power supply, charge the second battery.

11. The wireless headset according to claim 1, wherein the second external power supply is an electronic device;

the second interface is configured to: when being detached from the first interface and being electrically connected to the electronic device, receive audio data sent by the electronic device; and the second earplug is configured to play the audio data.

12. The wireless headset according to claim 1, wherein the second earplug comprises a second battery; and when the first interface is detached from the second interface, the first headset part is electrically connected to the second headset part through a connection component.

13. The wireless headset according to claim 12, wherein the connection component comprises a first magnetic attachment component on a back surface of the first earplug and a second magnetic attachment component on a back surface of the second earplug;

the first interface is configured to: when the first interface is detached from the second interface, the first interface is electrically connected to the first external power supply, and the first magnetic attachment component is electrically connected to the second magnetic attachment component, charge the first battery and the second battery; and the second interface is configured to: when the second interface is detached from the first interface, the second interface is electrically connected to a second external power supply, and the first magnetic attachment component is electrically connected to the second magnetic attachment component, charge the first battery and the second battery.

14. The wireless headset according to claim 12, wherein the connection component comprises a first connection plug electrically connected to the first interface and a second connection plug electrically connected to the second interface;

the first interface is configured to: when the first interface is detached from the second interface, the first interface is electrically connected to the first external power supply, and the first connection plug is electrically connected to the second connection plug, charge the first battery and the second battery; and the second interface is configured to: when the second interface is detached from the first interface, the second interface is electrically connected to a second external power supply, and the first connection plug is electrically connected to the second connection plug, charge the first battery and the second battery.

15. The wireless headset according to claim 12, wherein the connection component comprises a jumper configured to electrically connect the first interface and the second interface;

the first interface is configured to: when being detached from the second interface and being electrically connected to the first external power supply, charge the first battery and the second battery; and the second interface is configured to: when being detached from the first interface and being electrically connected to a second external power supply, charge the first battery and the second battery.

16. The wireless headset according to claim 1, wherein the wireless headset further comprises an input detection module;

the first interface is further configured to: when the first interface is detached from the second interface, and the input detection module detects an indication that a user indicates to charge an electronic device, output a current to the electronic device; and the second interface is further configured to: when the second interface is detached from the first interface, and the input detection module detects the indication that the user indicates to charge the electronic device, output a current to the electronic device.

17. The wireless headset according to claim 1, wherein when the first interface and the second interface are plugged together, the battery box and the cable control box are symmetrically distributed.

18. The wireless headset according to claim 1, wherein the first interface is a female connector, and the second interface is a male connector.

19. The wireless headset according to claim 18, wherein the first external power supply is a mobile power supply or a power plug, and the first interface is electrically connected to the first external power supply through a connection cable.

20. The wireless headset according to claim 18, wherein the first interface is a female connector of a USB Type-C connector, and the second interface is a male connector of the USB Type-C connector.

* * * * *